US008656978B2

(12) United States Patent
Goldenberg et al.

(10) Patent No.: US 8,656,978 B2
(45) Date of Patent: Feb. 25, 2014

(54) ROLLER SCREEN ASSEMBLIES

(75) Inventors: Shaul Goldenberg, Vaughan (CA); John Robert Davies, Vaughan (CA)

(73) Assignee: 420820 Ontario Limited, Ontario (CA)

( * ) Notice: Subject to any disclaimer, the term of this patent is extended or adjusted under 35 U.S.C. 154(b) by 275 days.

(21) Appl. No.: 11/826,222

(22) Filed: Jul. 13, 2007

(65) Prior Publication Data

US 2008/0053623 A1 Mar. 6, 2008

Related U.S. Application Data

(60) Continuation-in-part of application No. 11/448,851, filed on Jun. 8, 2006, now Pat. No. 7,967,345, and a continuation-in-part of application No. 11/433,445, filed on May 15, 2006, now abandoned, which is a division of application No. 09/740,965, filed on Dec. 21, 2000, now abandoned, which is a division of application No. 09/035,152, filed on Mar. 5, 1998, now Pat. No. 6,209,610, which is a continuation-in-part of application No. 08/962,263, filed on Oct. 31, 1997, now Pat. No. 6,446,696, which is a continuation-in-part of application No. 08/362,995, filed on Dec. 23, 1994, now Pat. No. 5,687,506, which is a continuation-in-part of application No. 08/281,620, filed on Jul. 28, 1994, now Pat. No. 5,682,710.

(51) Int. Cl.
*E06B 9/08* (2006.01)

(52) U.S. Cl.
USPC ..... 160/31; 160/23.1; 160/122

(58) Field of Classification Search
USPC ..... 160/26, 27, 28, 99, 98, 100, 31, 274, 160/280, 273.1, 122, 120
See application file for complete search history.

(56) References Cited

U.S. PATENT DOCUMENTS

| | | | | | |
|---|---|---|---|---|---|
| 1,352,350 | A * | 9/1920 | Burns | 160/267.1 |
| 2,235,295 | A | 3/1941 | Morgan | |
| 4,877,076 | A | 10/1989 | Komori | |
| 5,682,710 | A | 11/1997 | Davies | |
| 6,059,007 | A * | 5/2000 | Tomita | 160/242 |
| 6,082,432 | A * | 7/2000 | Kissinger | 160/290.1 |
| 6,138,740 | A | 10/2000 | Chou | |
| 6,209,610 | B1 | 4/2001 | Davies | |
| 6,267,168 | B1 | 7/2001 | Davies | |
| 6,397,921 | B1 | 6/2002 | Wartenbergh | |
| 6,405,781 | B2 | 6/2002 | Davies et al. | |
| 6,408,922 | B2 * | 6/2002 | Desrochers | 160/24 |
| 6,446,696 | B1 | 9/2002 | Davies et al. | |
| 6,463,983 | B1 * | 10/2002 | Lang | 160/23.1 |
| 6,478,070 | B2 * | 11/2002 | Poppema | 160/23.1 |
| 6,655,444 | B2 | 12/2003 | Goldenberg | |
| 6,701,994 | B2 | 3/2004 | Goldenberg | |

(Continued)

*Primary Examiner* — Blair M. Johnson
(74) *Attorney, Agent, or Firm* — Caesar, Rivise, Bernstein, Cohen & Pokotilow, Ltd.

(57) ABSTRACT

A closure assembly to be installed in an opening for a building, said closure assembly comprising a frame for supporting a moveable closure member therewithin, said frame including top, bottom and side members, one of the members including a hollow pocket within the interior of said member and for receiving a spring biased roller assembly upon which a flexible material is accumulated, said flexible material being selected from a blind, a bug screen, a solar screen, or the like, the flexible material being movable between a fully retracted first position whereat the material is contained within the pocket to a fully extended second position whereat the material covers some or all of the opening of the building.

24 Claims, 48 Drawing Sheets

(56) References Cited

U.S. PATENT DOCUMENTS

| | | | | |
|---|---|---|---|---|
| 6,851,464 | B2 | 2/2005 | Hudoba | |
| 7,195,053 | B2 | 3/2007 | Pylkki | |
| 7,210,513 | B2 * | 5/2007 | Goldenberg | 160/31 |
| 7,487,816 | B2 * | 2/2009 | Moriya et al. | 160/31 |
| 2001/0000878 | A1 | 5/2001 | Davies | |

* cited by examiner

Figure I

ROLLER SCREEN ASSEMBLIES

This application is a continuation-in-part of U.S. application Ser. No. 11/448,851 filed on Jun. 8, 2006 now U.S. Pat. No. 7,967,345 and a continuation-in-part of U.S. patent application Ser. No. 11/433,445 filed on May 15, 2006 now abandoned which is a divisional of U.S. patent application Ser. No. 09/740,965 filed on Dec. 21, 2000 now abandoned , which is a divisional of application Ser. No. 09/035,152 filed on Mar. 5, 1998, now U.S. Pat. No. 6,209,610, which is a continuation-in-part of application Ser. No. 08/962,263 filed Oct. 31, 1997, now U.S. Pat. No. 6,446,696, which is a continuation-in-part of application Ser. No. 08/362,995 filed Dec. 23, 1994, now U.S. Pat. No. 5,687,506, which is a continuation-in-part of application Ser. No. 08/281,620 filed Jul. 28, 1994, now U.S. Pat. No. 5,682,710, from which priority is claimed.

FIELD OF INVENTION

This invention relates to improvements to roller assemblies and specifically embodied on a roller cassette to be used with closure assemblies. In one example the frame of a window assembly includes both a bug screen and a blind material provided with a replaceable roller cassette disposed within opposite jamb sections of a window assembly.

BACKGROUND OF THE INVENTION

It is well known to provide roller blinds for windows. Typically these roller blinds are included on a roller assembly that is mounted above a typically window. The roller blind is pulled down over the window and blocks the sunlight. Normally, the roller blind is mounted on brackets that are positioned above the frame of the window or alternatively maybe installed on the frame of the window.

Such an installation is inconvenient, clumsy, and unattractive. The roller blind assembly is visible at all times and may disrupt the appearance of the window and detract from decorating scheme of a particular room.

Roll out screen assemblies are well known and may be provided as a supplementary assembly to be installed on a jamb of a window assembly such as those manufactured and sold by the Phantom® or screens are alternatively as sold by Preferred Engineering Ltd. including bug screen mesh installed on a roller assembly which is hidden within the hollow of a jamb of a window assembly as disclosed in the U.S. Pat. No. 6,209,610 owned by the assignee of this application. The disclosure of that application is incorporated by reference in its entirety with respect to the teachings of roll out mesh screen assemblies, from which this application claims priority and specifically from U.S. patent application Ser. No. 11/433,445 filed on May 15, 2006 a divisional of the granted U.S. Pat. No. 6,209,610.

In the prior patent literature of Preferred Engineering U.S. Pat. No. 6,267,168 there is also a teaching of how to manufacture a roll out screen assembly as a replaceable screen cassette and also a teaching how to replace the screen cassette:

The screen cassette is assembled in a complete form upon brackets and having glides provided therewith for installation within a jamb section having the generally arcuate shaped pocket.

As best seen in FIGS. 50 to 53 the cassette is oriented at an angle in relation to the sill and the header. The sill includes a supporting shelf which will support the lower bracket of the cassette. The upper bracket, therefore, is inserted within the void in the header to receive the entire upper bracket in the void. The bottom bracket of the cassette is then rotated about the top bracket toward the sill portion to avoid the shelf portion and finally to end up in a position wherein the entire upper bracket is disposed within the void of the header, while the lower bracket and the glide do not engage the portions of the sill portion, but the entire cassette is now disposed within the pocket of the jamb section in a parallel relationship thereto.

The cassette is then moved downwardly so that the upper bracket now enters the arcuate shaped pocket of the jamb section, and the lower arcuate bracket rests upon the shelf while the glides are contained within the bottom channels disposed with the sill and within the upper channel within the header section. Gravity, therefore, keeps the arcuate bracket in contact with the arcuate pocket and secures the screen cassette within the jamb section.

Is therefore a primary object of this invention to provide a roll out cassette assembly including solar blind, bug screen and blind materials which are disposed within frame elements of closure assemblies incorporating a pocket or, alternatively a housing proximate each side of a closure assembly.

It is a further object of the invention to provide a roller assembly for blind material which extends from one jamb section of the closure assembly and which also provides a bug screen roller assembly extending from the opposite jamb section of the closure assembly.

It is a further object of this invention to provide the above mentioned assemblies to improve; the aesthetics of the closure assembly, and the appearance to the home owner.

It is yet a further object of the invention to provide said roll out assembly which incorporates the aspect of being hidden until such time as it is desired to cover an opening in a building.

Further and other objects of the invention will become apparent to those skilled in the art when considering the following summary of the invention and the more detailed description of the preferred embodiments illustrated herein.

SUMMARY OF THE INVENTION

According to a primary aspect of the invention there is provided a closure assembly to be installed in an opening for a building, said closure assembly comprising a frame for supporting a moveable closure member therewithin, said frame including top, bottom and side members, one of the members including a hollow pocket within the interior of said member and for receiving a spring biased roller assembly upon which a flexible material is accumulated, said flexible material being selected from a blind, a bug screen, a solar screen, or the like, the flexible material being movable between a fully retracted first position whereat the material is contained within the pocket to a fully extended second position whereat the material covers some or all of the opening of the building.

Preferably flexible material extends from the hollow pocket of at least two opposing members of the frame.

In one embodiment one of the materials is solar screening and the second material is bug screening.

The closure assemblies may be selected from patio doors, double hung windows, single hung windows, tilt and slide windows with single movable and double movable sashes, casement windows, double casement windows, awning windows, exit doors and screen doors.

Preferably said members further comprise a header, sill, and two jambs.

Preferably in another embodiment two of the members include a hollow pocket.

In another embodiment said pocket is integrately formed with said member.

Preferably said spring biased roller assembly is fully contained in the pocket.

In another embodiment the other frame members, for example the header and the sill when the pocket is provided in opposing jambs, include track portions for guiding a leading edge of the flexible material to and from the first and second positions as the flexible material moves across the building opening.

Preferably a draw bar is connected to the leading edge of said flexible material which includes guides which ride in said track portions. In another embodiment said guides include retractable pins which are retracted by the operation of a preferred central locking mechanism provided with said draw bar.

More preferably said tracks include multiple locking detents for engagement with said retractable pins at a number of predefined positions along said track to enable positioning of the flexible material at those positions, such as for example in the case when the flexible material is a blind, these positions may further comprise fully extended, half extended and fully retracted positions.

In another embodiment said flexible material is bug screening extending from the pocket of one member, and blind material extending from the pocket of a second member.

In another embodiment when the closure assembly is a double casement window assembly and blind material or solar screening is disposed in the pocket of one of the frame members, the blind or solar screen is fully extendable across both casement windows, and also extends in a second manner across only one casement window, wherein the pocket of the opposing frame member may contain bug screening operating in the same manner. Preferably when bug screening extends from both pockets, and the draw bars thereof engage the track at predetermined positions, both screens combining to fully cover the full extent of the opening of the building.

According to yet another aspect of the invention there is provided a closure assembly comprising two ends and two sides and having disposed at each end, or alternatively each side, a housing containing a spring biased roller assembly upon which a flexible material is accumulated, the flexible material being moveable, from a fully retracted position in said housing to a fully extended position, within a track disposed with each side or alternatively at each end of the assembly, said track including a multiplicity of detent positions for retaining a leading edge of the flexible material extending from each spring biased roller assembly and for engaging said leading edge with said track at each of said positions, adjacent the leading edge of said flexible material, said leading edge including a draw bar with corresponding operative detents for engagement at said multiplicity of positions of each track, said flexible material being selected from solar screening, bug screening and blinds or the like, wherein when needed the applicable material may be moved between the fully retracted and fully extended positions for example a blind, or a solar screen.

According to still yet another aspect of the invention there is provided a screen assembly comprising two ends and two sides and having disposed at each end, or alternatively each side, a housing containing a spring biased roller assembly upon which a flexible material is accumulated, the flexible material being moveable, from a fully retracted position in said housing to a fully extended position, within a track disposed with each side or alternatively at each end of the assembly, said track including a multiplicity of detent positions for retaining a leading edge of the flexible material extending from each spring biased roller assembly and for engaging said leading edge with said track at each of said positions, adjacent the leading edge of said flexible material, said leading edge including a draw bar with corresponding operative detents for engagement at said multiplicity of positions of each track, said flexible material being selected from solar screening, bug screening and blinds or the like, wherein when needed the applicable material may be moved between the fully retracted and fully extended positions for example a blind, or a solar screen.

Preferably the screen assembly may further comprise an add on replacement screen assembly for a patio door or entry door.

Preferably said patio door may further comprise a French door assembly. In another embodiment of said screen assembly at least three housings are provided, each carrying flexible material on a roller cassette.

It is preferred that the flexible material for each cassette be unique but the flexible material for each cassette may also not be unique.

According to another aspect of the invention there is provided a system for readily interchanging the material covering an opening of a closure assembly including a spring biased roller cassette to be inserted in the pocket of a frame member of the closure assembly:

(a) providing a standard design for the cassette;
(b) making available various materials extending between a draw bar and a roller for each cassette;
(c) providing a standard pocket design to receive each cassette in such a manner that the cassette may be readily placed into and removed from the pocket; and
(d) replacing the cassette as desired in the appropriate conditions;

wherein a homeowner may easily replace the material covering the opening of the closure assembly by interchanging the cassettes as desired. In one embodiment the system further comprises a roller assembly upon which the flexible material (as described above) is accumulated.

Preferably the system for interchanging the screen cassettes of abovementioned consists of at least two steps:

removal of a first cassette containing a first material from the pocket of the frame member,
followed by the insertion of second cassette carrying a second material into the pocket of the frame member.

DETAILED DESCRIPTION OF THE PREFERRED EMBODIMENTS

Figure 1:
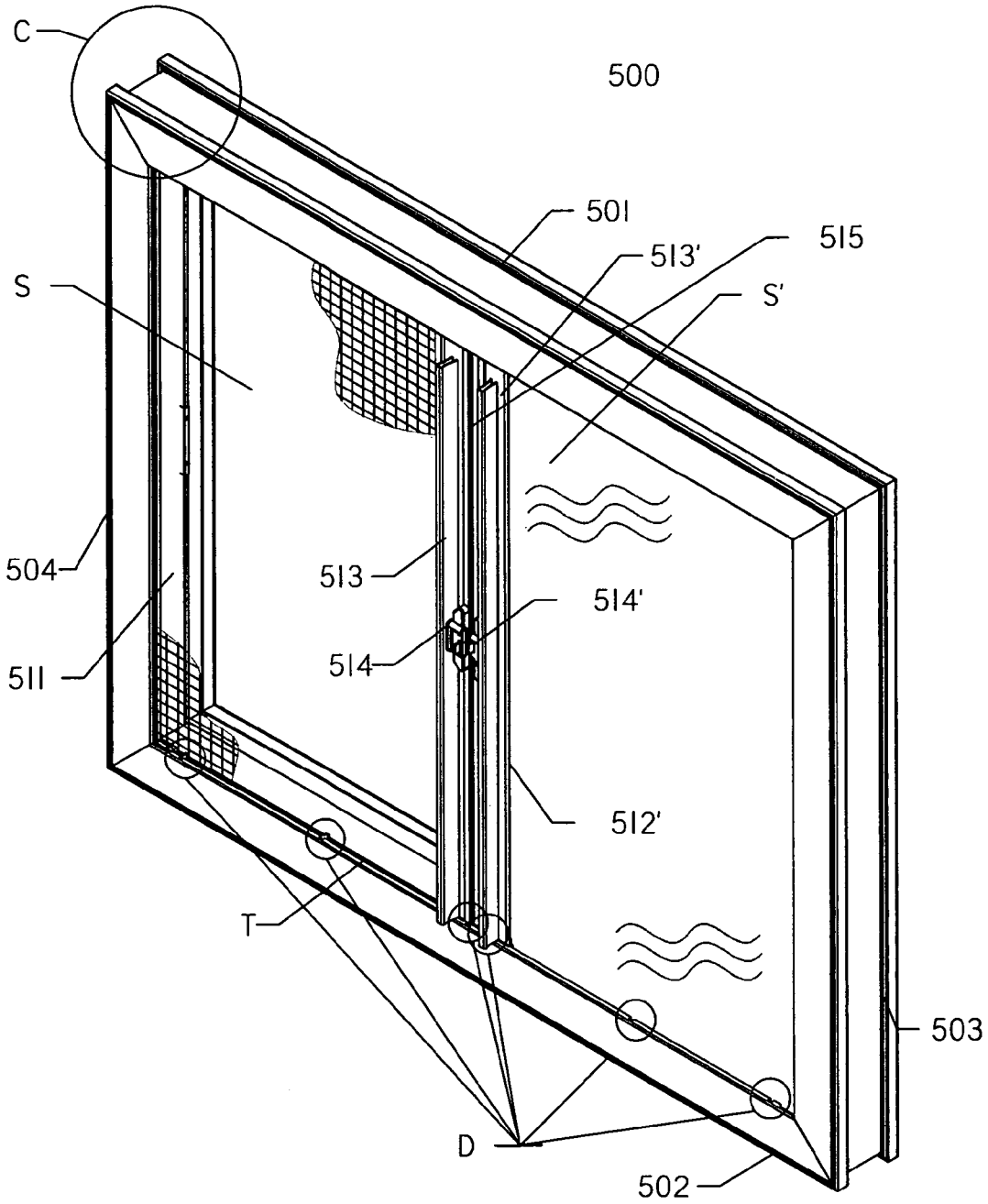
FIG. 1 is a schematic perspective view of a double casement window with the blind S' partially extended from the left jamb and the bug screen S partially extended from the right jamb, illustrated in a preferred embodiment of the invention.
Figure 2:
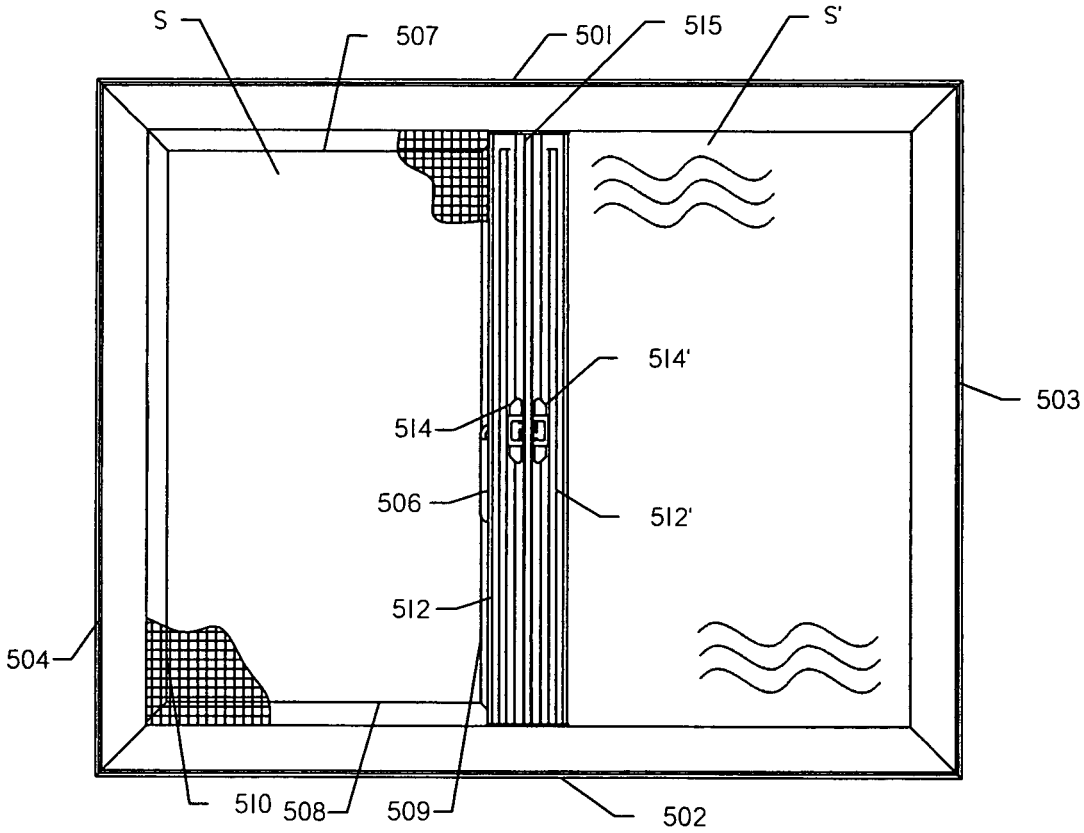
FIG. 2 is a front view of the window of the FIG. 1.

Referring now to FIGS. 1 to 7 there is illustrated a double casement window assembly 500 including an outer frame containing a header 501, a sill 502, a right jamb 503 and a left jamb 504. Additionally the assembly contains two sashes, left and right, including sash frame members 507, 508, 509 and 510 for the left sash and sash frame members 507', 508', 509', and 510' for the right sash. Each sash has a locking device 506 and 506' best depicted on FIG. 3. Left jamb 504 has a pocket P best illustrated in FIG. 43 which contains roll cassette 511 also illustrated in FIG. 42. The right jamb 503 includes a pocket with a roll cassette 511' which contains a blind S' made of plastic or alternative equivalent materials.

Figure 3:
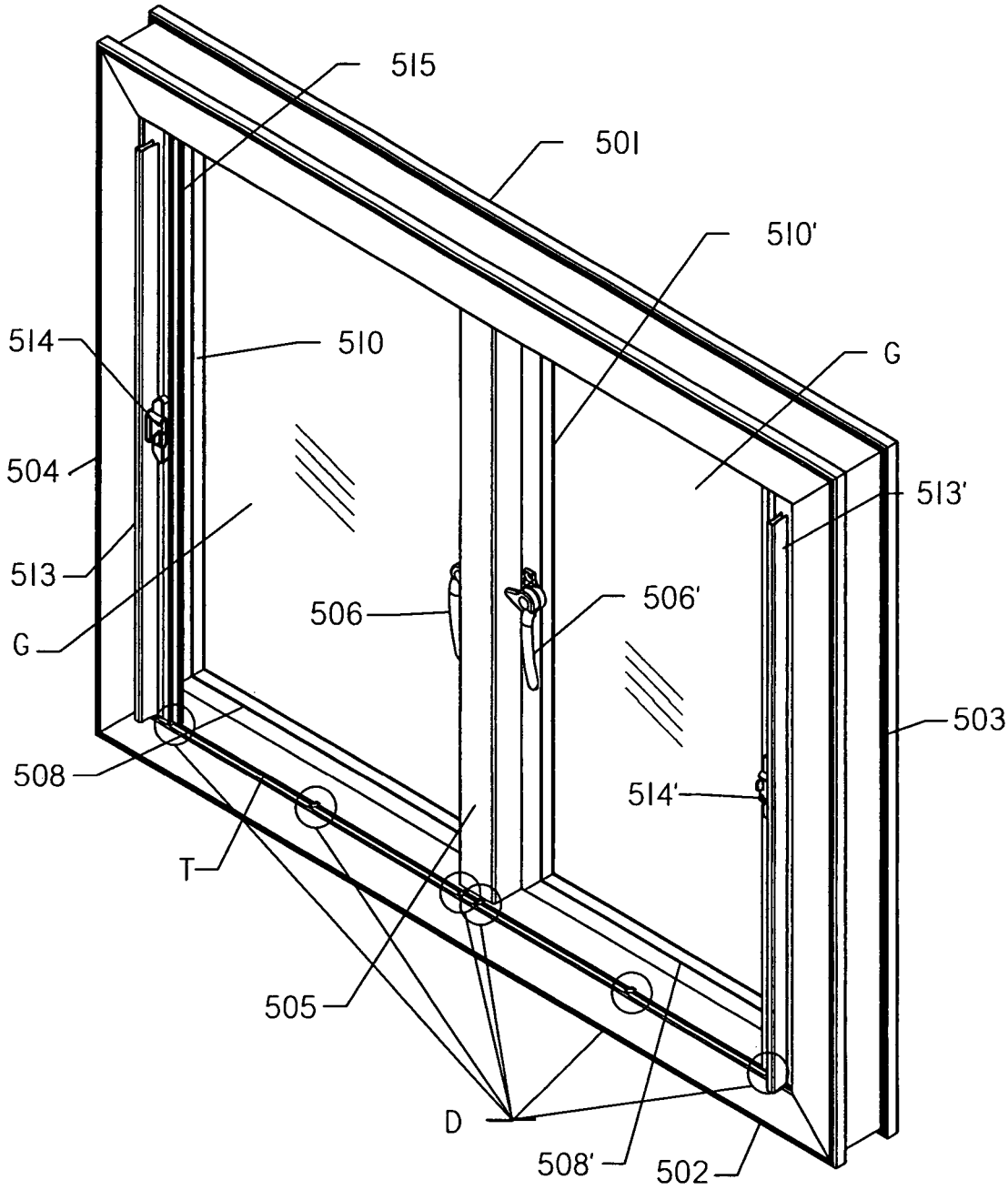
FIGS. 3, 4, 5, 6 and 7 are schematic perspective views of various operational modes of the double casement window of FIG. 1.

Both sill 501 and header 502 of the window frame include tracks T to guide the rollout assembly movement as best seen in on FIG. 3. Each track T in the header 502 and the sill 501 contains multiple detents D that allow locking of rollout assemblies at predetermined positions inside the window frame. Each detent D is a cut out positioned at each track T.

Referring now to FIG. 1 there is illustrated an operating position for the rollout assemblies. The bug screens S is extended from the screen cassette 511 to the mullion 505 of the window 500 while the blind S' is extended from the blind cassette 511' to the mullion 505 of the window whereat a bug seal 515 exists between the two draw bars 512 and 512'.

Referring now to FIG. 3 the bug screen S is fully retracted into the screen cassette 511 while the roll out blind S' is fully retracted into its screen cassette 511', allowing the windows to be opened prior to extending either the bug screen or the blind.

Figure 4:
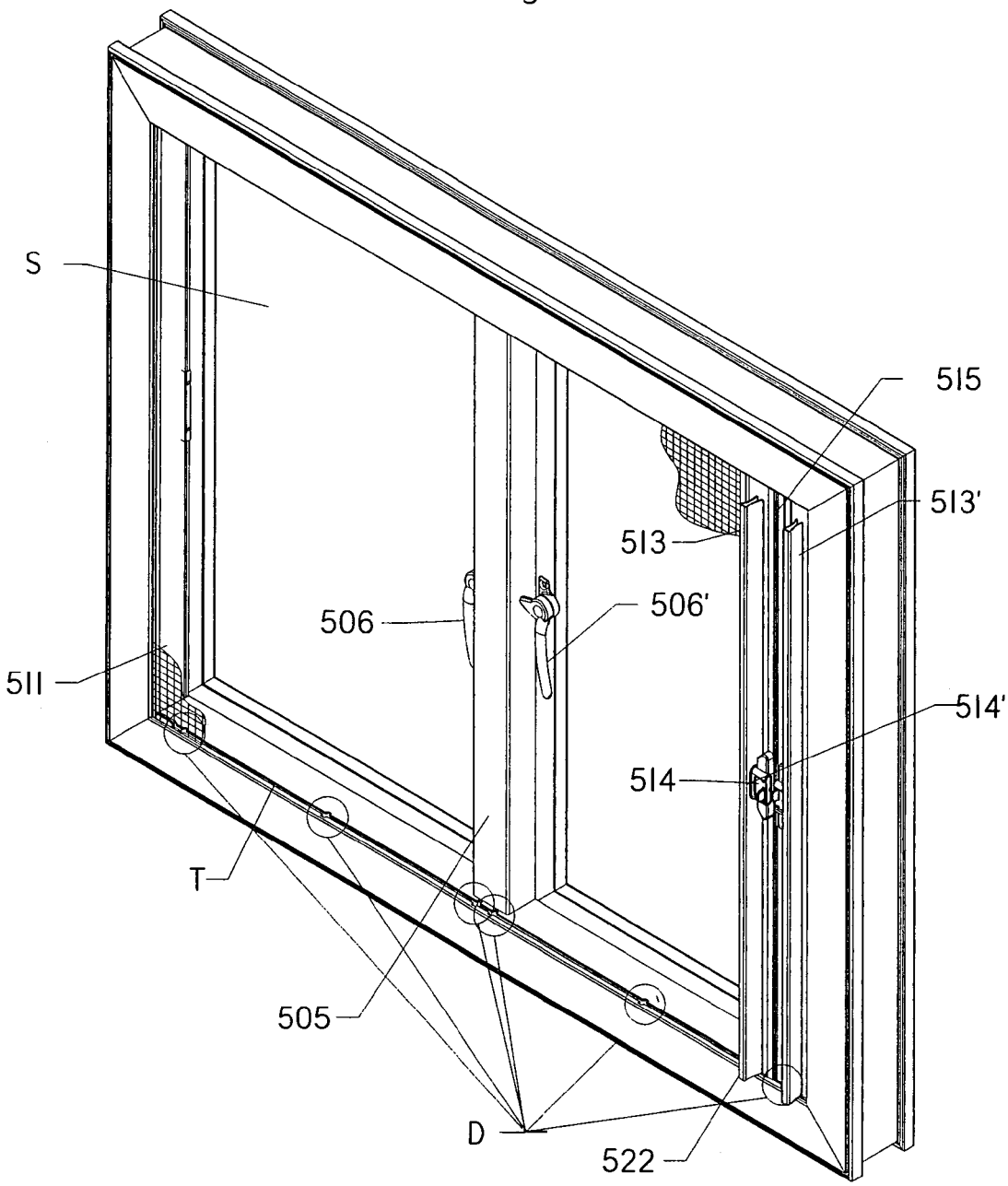

Referring now to FIG. 4 the blind S' has been fully retracted into blind cassette 511' while the bug screen S remains fully extended from the screen cassette 511, contained in the pockets for the left jamb 504 and the right jamb 503 respectively.

Figure 5:
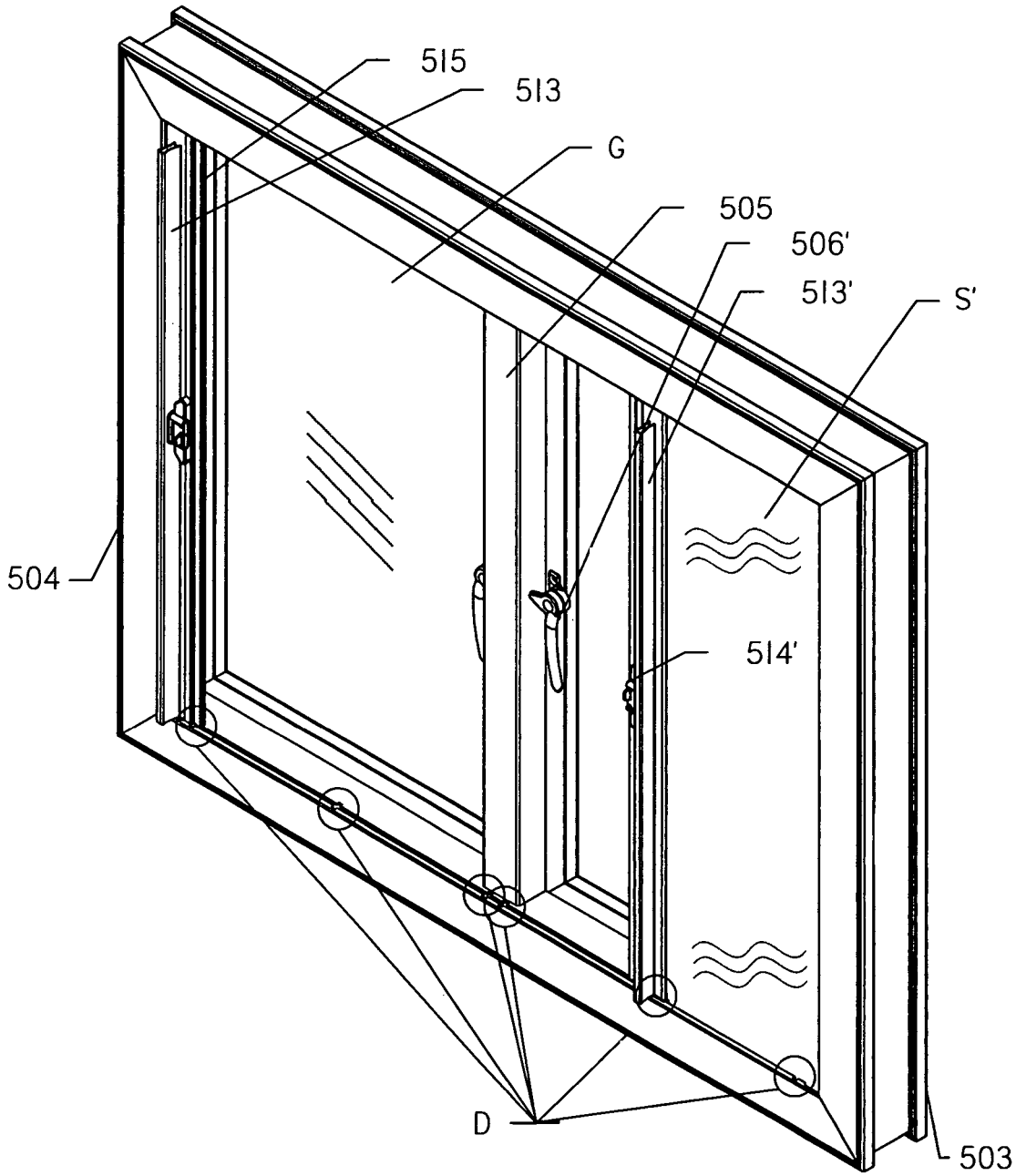

Referring now to FIG. 5 the bug screen S is fully retracted into the screen cassette 511 contained inside the pocket of the left jamb 504, while the blind S' remains partially extended from the blind cassette 511' contained in the pocket of the right jamb 503. The blind is locked in an intermediate position by engaging the draw bar 512' with the detents as will be described hereinafter.

Figure 6:
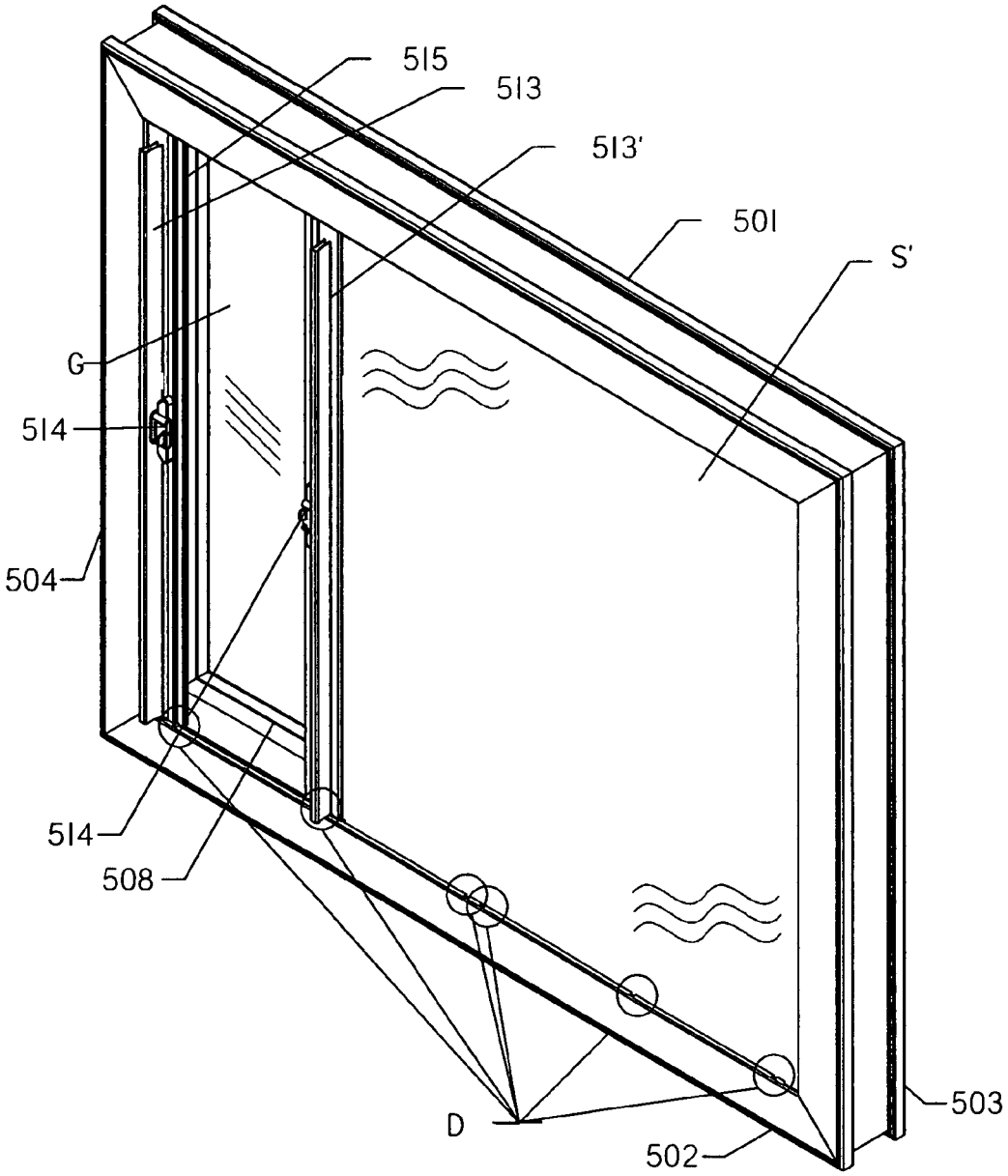

Referring now to FIG. 6 the blind S' is further extended from the position illustrated in FIG. 5. Here the blind S' is covering about ¾ of the window frame while the bug screen S is fully retracted into the screen cassette 511.

Figure 7:
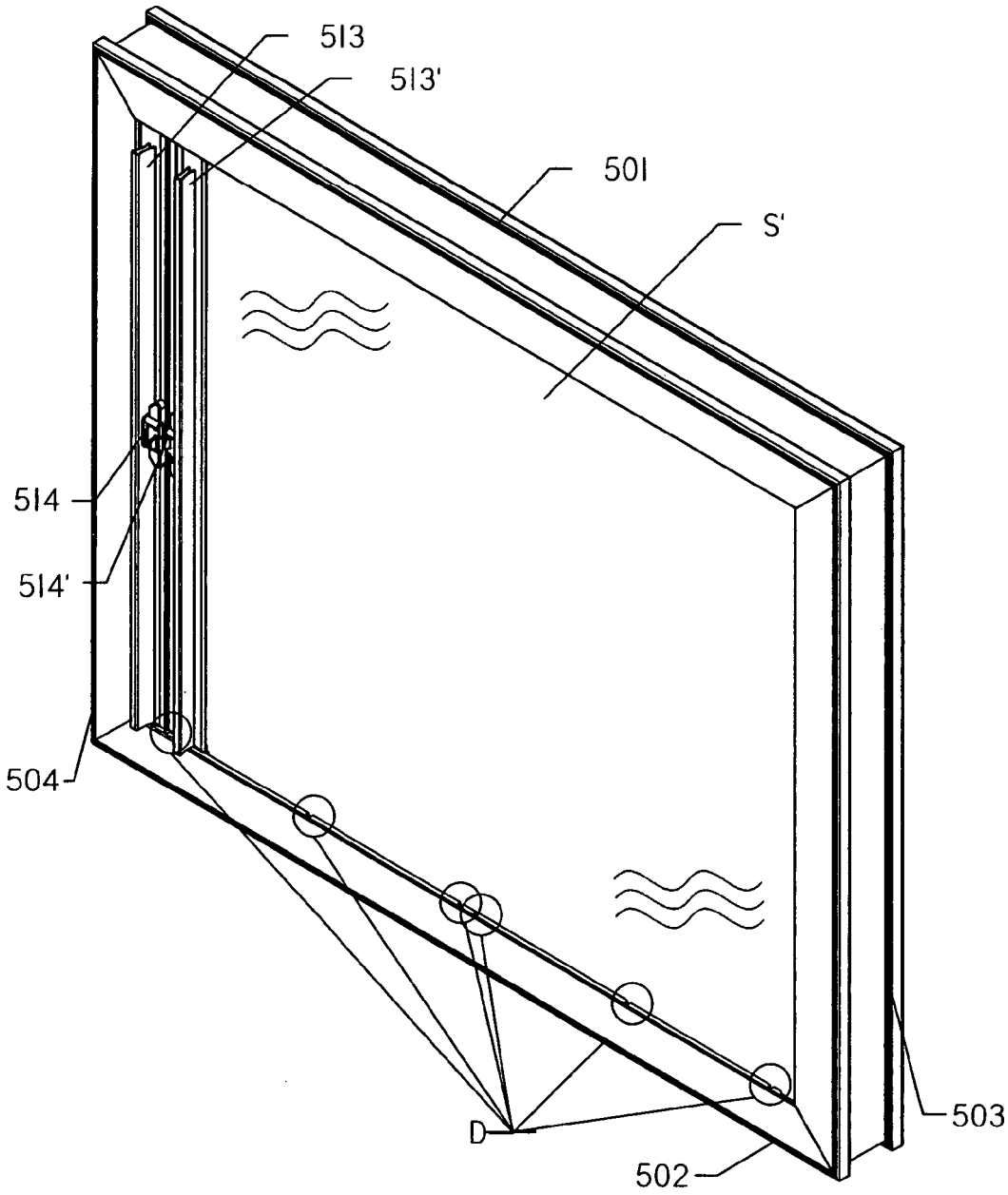

Referring to FIG. 7 the blind S' is fully extended from the cassette 511' towards the left jamb 504 of the window 500, fully covering the window with by the plastic blind S'. By installing two cassettes 511 and 511' and strategically placing detents along the tracks of the rollout screens, the screen S and blind S' for double casement window may be placed in various modes namely; uncovered as seen in FIG. 3, fully covered by bug screen S as seen in FIG. 4, half protected by bug screen S and half covered by blind S' as seen in FIG. 1, partially covered by the blind S' as seen in FIGS. 5, and 6 and finally fully covered by the blind S' as illustrated in FIG. 7. These various modes for the screen consider and blind cassette equally apply to all types of closure assemblies illustrated herein.

Figure 8:
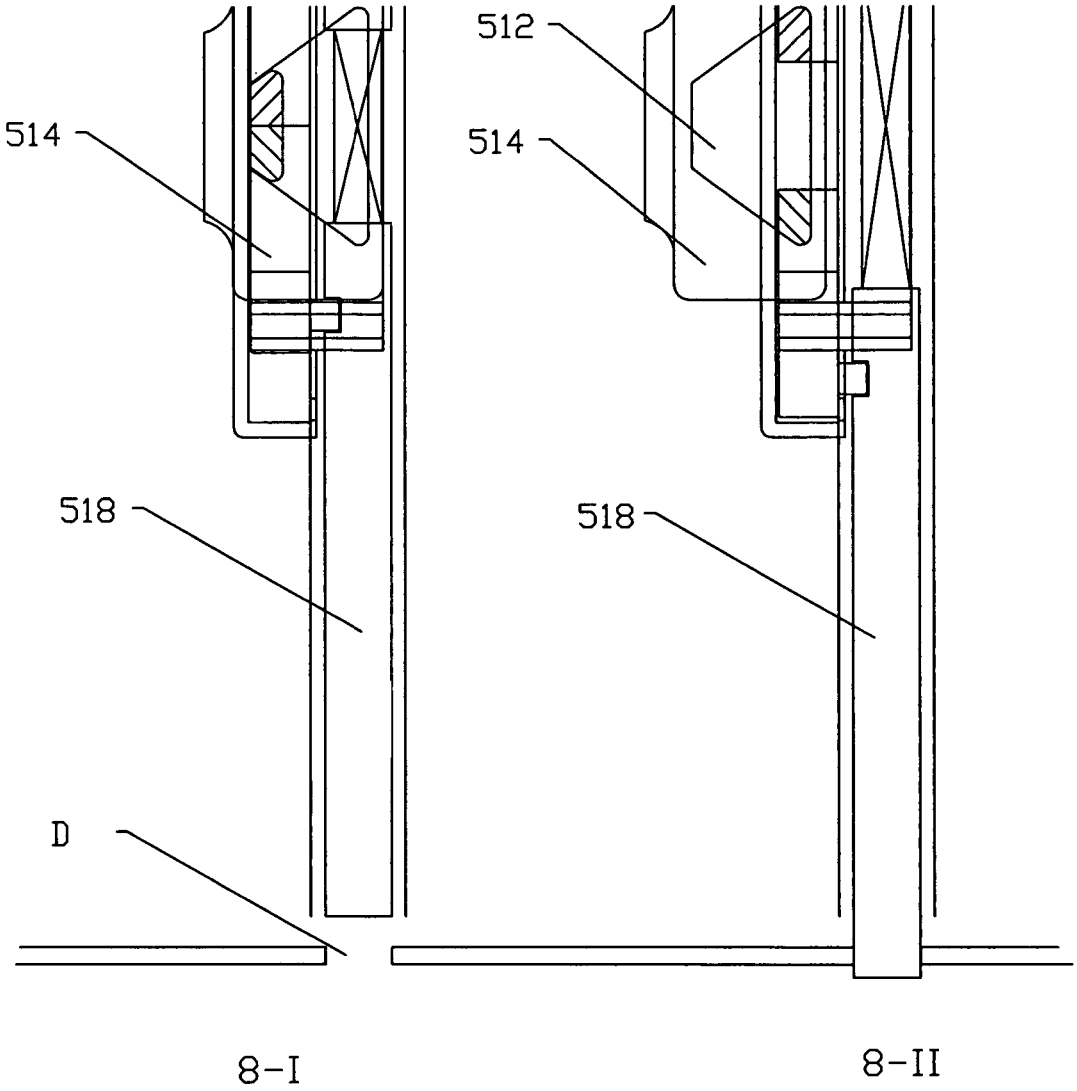
FIG. 8 is a schematic side view of the operating positions for the detents with retractable pins of the window of FIG. 1.

Referring to FIG. 8 there is illustrated a schematic side cut out view of a latch assembly 512 including release members 518. Position (I) in FIG. 8 illustrates the retractable pin 518 being released from the detent D, whereat draw bar 512 is free to move along the track T. Position (II) in FIG. 8 illustrates the retractable pin 518 engaged with the detent D whereat in this position draw bar 512 is locked and restricted from any movement. By operation of the latch operator 514 and retracting the pin 518 as shown in position I the homeowner may pull the draw bar handle 513 to permit the roll out screen to extend from the screen cassette. Subsequently the latch operator 514 may be released resulting in, the retractable pin 518 engaging with one of the multiple detents D then preventing any further movement of the draw bar until the further operation of the latch operator 514.

Figure 9:
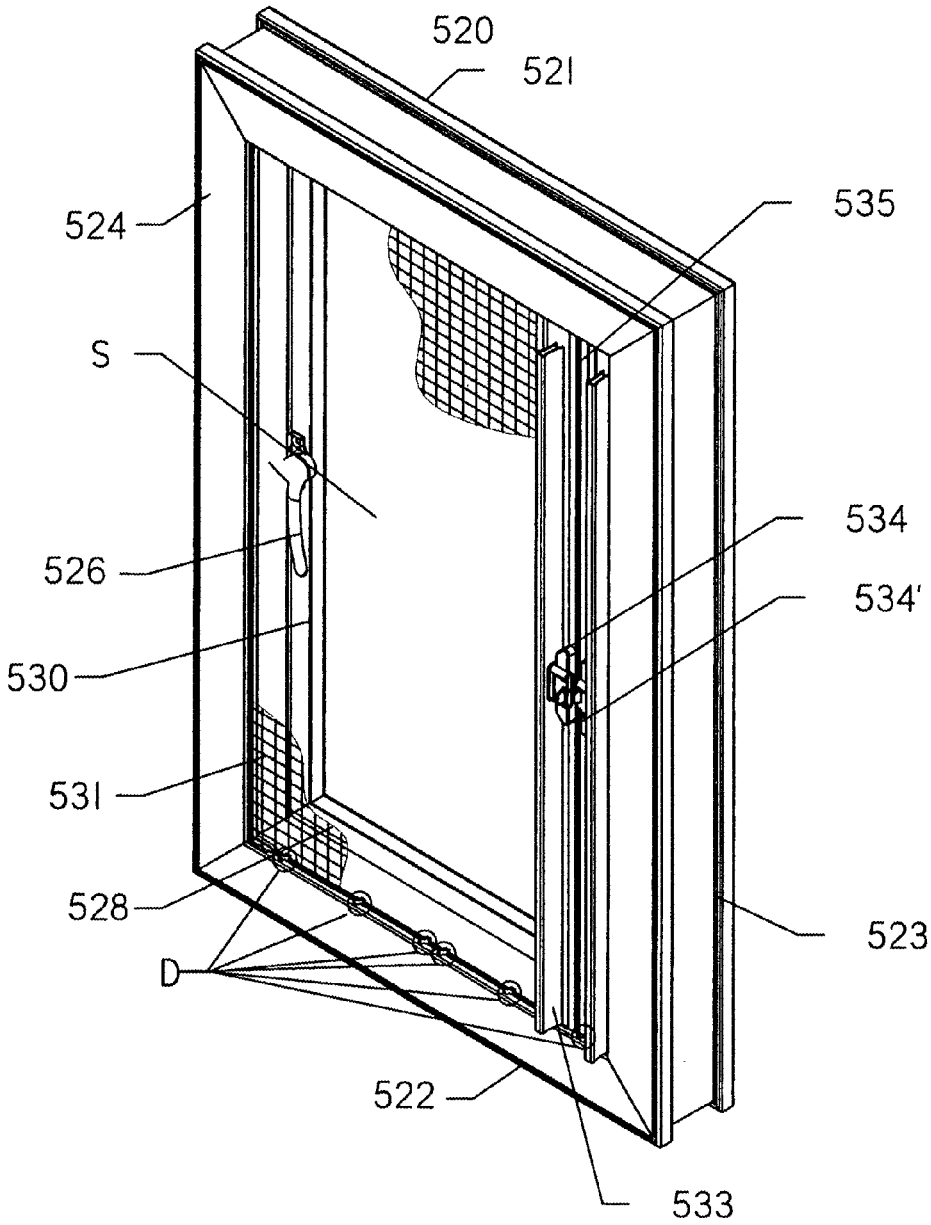
FIGS. 9 and 10 are schematic perspective views of operational modes of a single casement window containing two roll out assemblies illustrated in a preferred embodiment of the invention.
Figure 10:
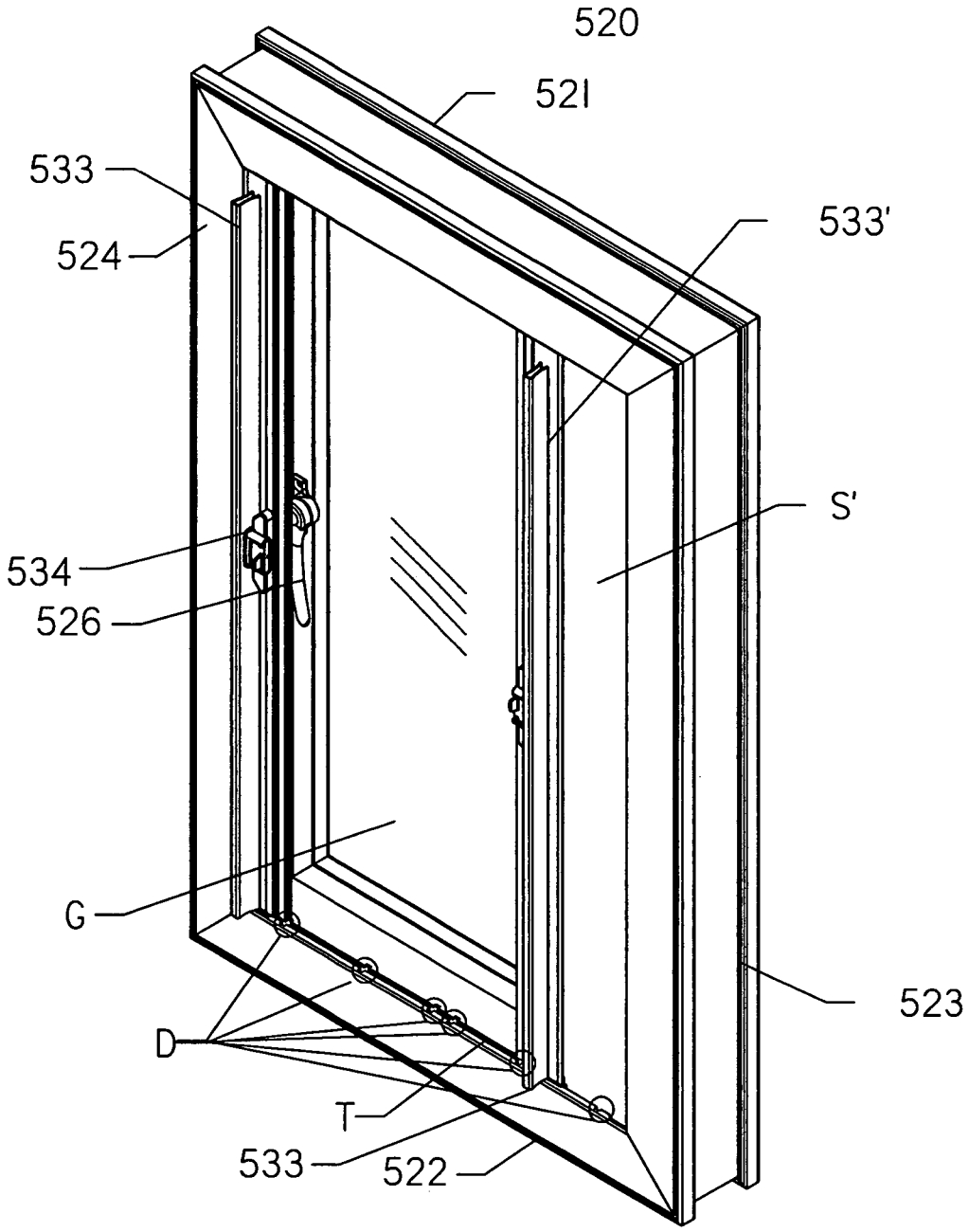

Referring now to FIGS. 9 and 10 there is illustrated the single casement window 520 that includes an outer frame which consists of header 521 and sill 522, right jamb 523 and left jamb 524. Further the assembly includes a sash contained within the outer frame including frame members 527, 528, 529 and 530. The sash includes a sash locking device 526. Left jamb 524 include a pocket P containing screen cassette 531 which carries a bug screen S while the right jamb 521 has a pocket that contains a blind cassette 531'. Both the header 521 and the sill 522 include tracks T that allow motion of rollout screen/blind horizontally from the left jamb to right and also from right jamb to the left. The tracks T contain detents D (preferably cutouts) that allows for engagement of the draw bars 532 and 532' at predetermined positions along the track T.

Referring now to FIG. 9 the bug screen S is fully extended from the screen cassette 531 to the opposite jamb 523. There is a bug seal 535 provided on the vertical edge of draw bars 532 and 532' to seal these edges when the rollout assemblies are position in close proximity, whereat the bug seals are engaged.

In the same manner as described in relation to FIGS. 1-7, there are various operational positions for the rollout screen/blind which can also be used with a single casement window from fully retracted to fully extended positions. In FIG. 10 the bug screen S is fully retracted into the cassette 531 while plastic blind S' is partially extended from blind cassette 531' and engaged one of in the detents D along the track T.

Figure 11:
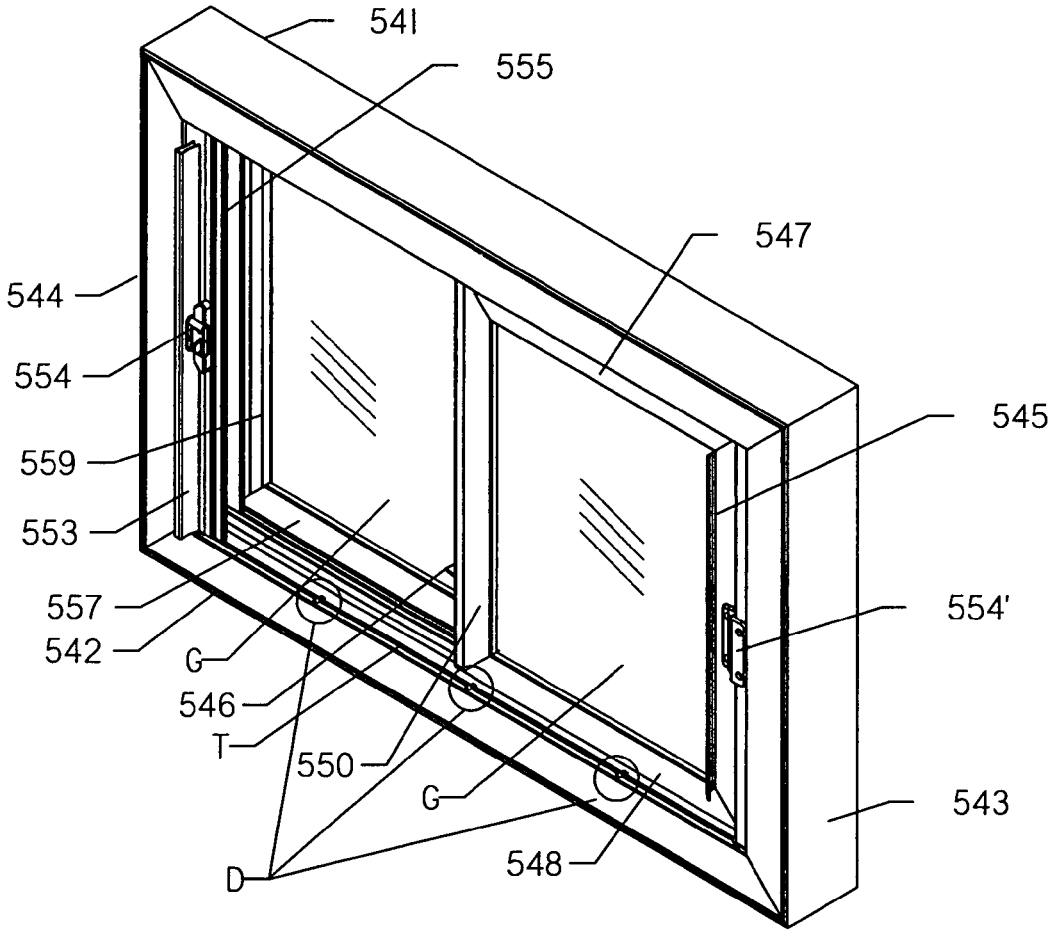
FIGS. 11 and 12 are schematic perspective views of operational modes of a single slider window with two roll out assemblies and illustrated in a preferred embodiment of the invention.
Figure 12:
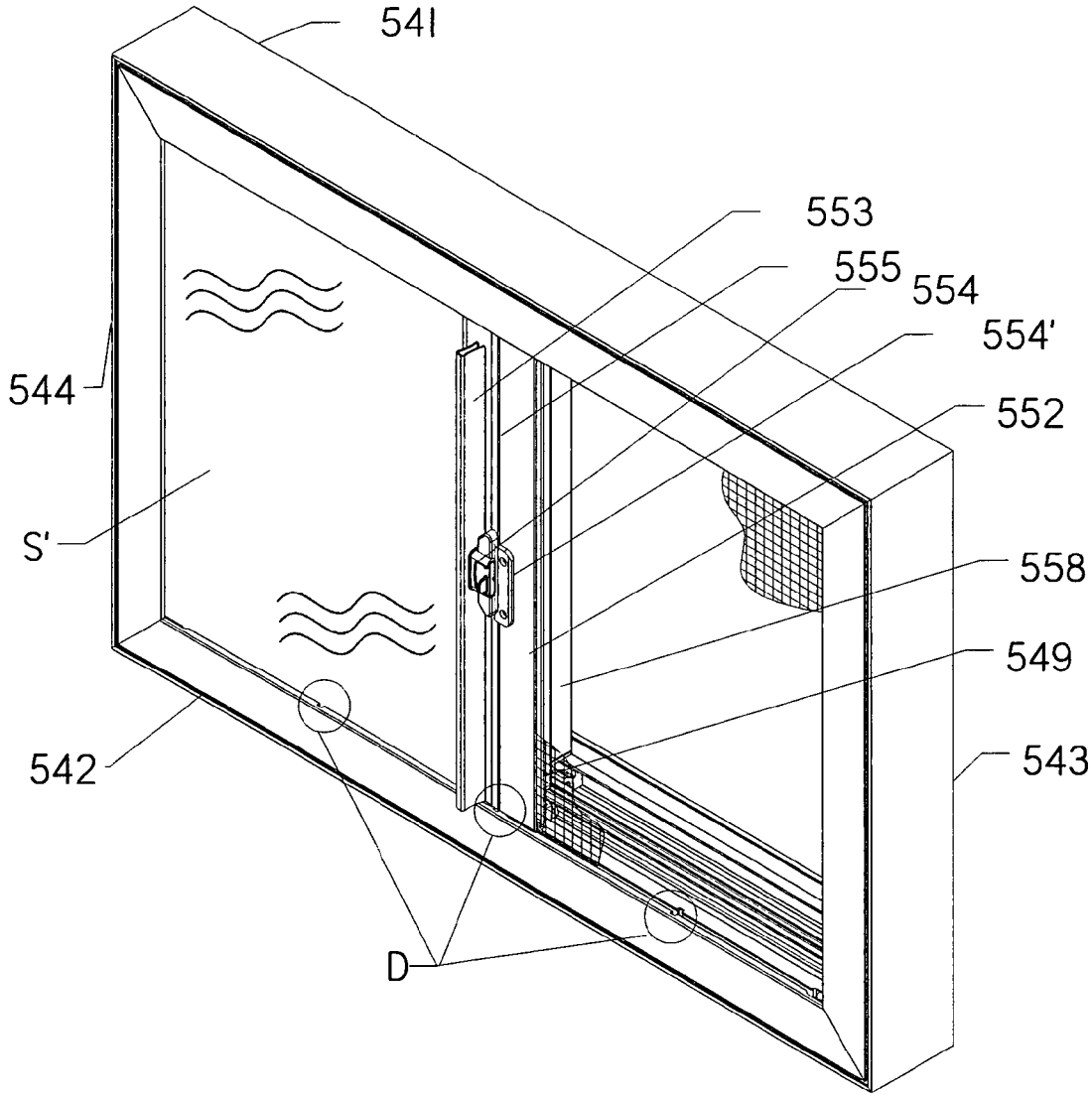
Figure 13:
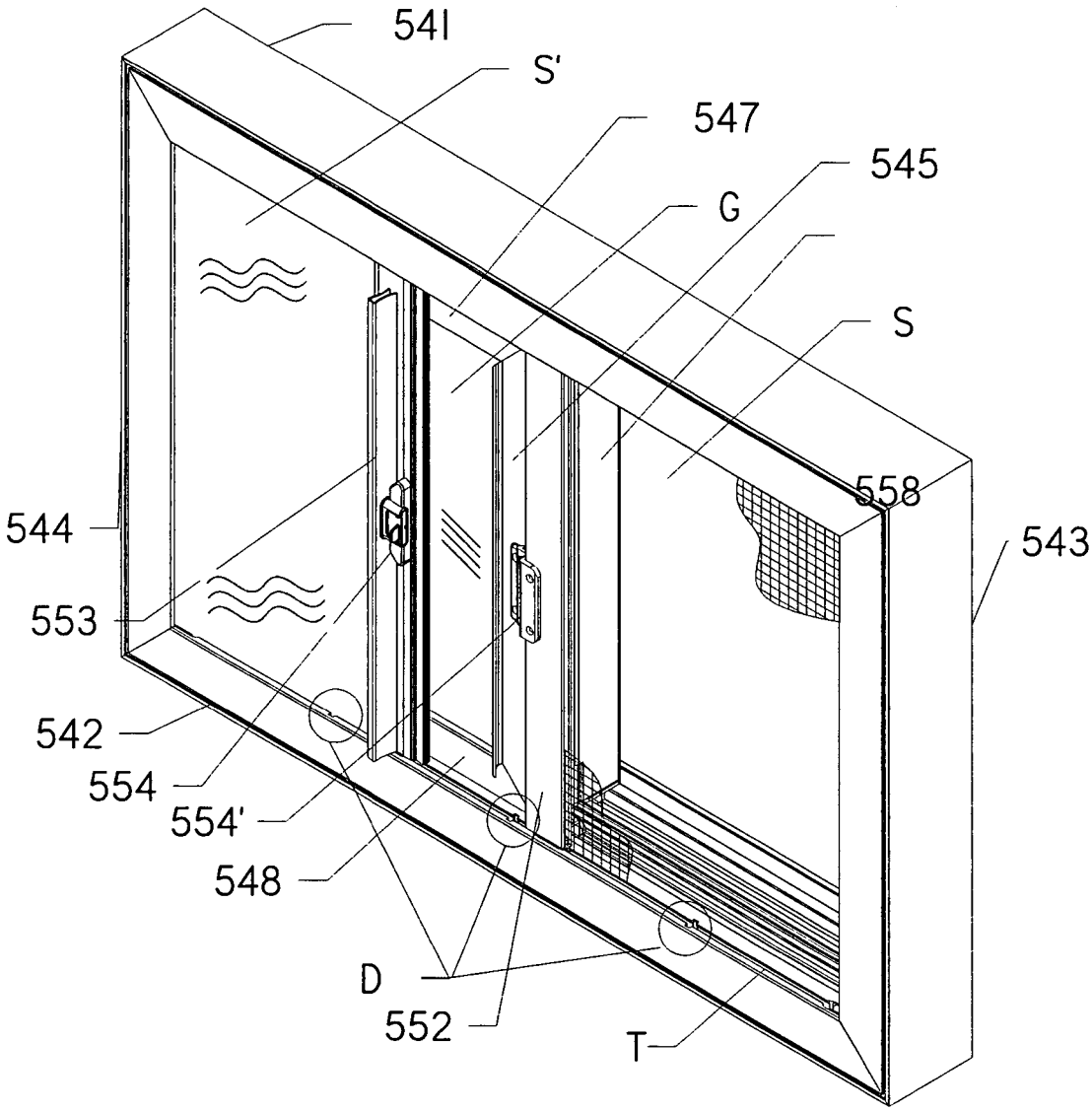
FIGS. 13 and 14 are schematic perspective views of operational modes of a double slider window with two roll out assemblies and illustrated in a preferred embodiment of the invention.
Figure 14:
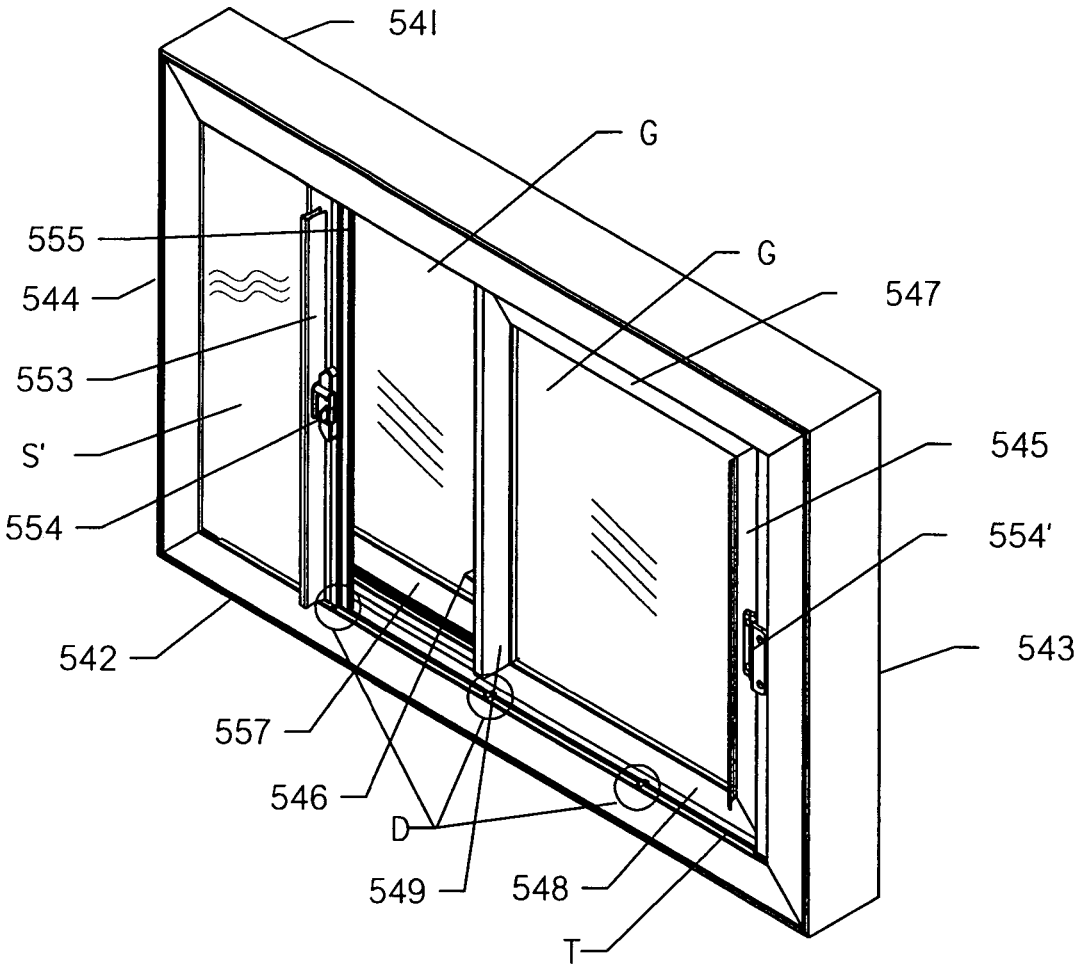

Referring to FIGS. 11, 12, 13 and 14 there are illustrated single and double tilt and slide windows respectively. In FIGS. 11 and 12 there is illustrated a single tilt and and slide window wherein only one sash is moveable within the other sash being stationary. In FIGS. 13 and 14 there is illustrated a double tilted slide window moveable. The window assembly 540 includes an outer frame portion which consists of header 541, sill 542, right jamb 543 and left jamb 544. Left jamb 544 has a pocket P containing screen cassette 551 while opposite jamb 543 has a pocket P containing a screen cassette 531' with the rollout bug screen S. The window assembly has two sashes one moveable in the front of the another stationary sash is known in the art. The front sash as best seen in FIG. 11 consists of frame members 547, 548, 549, 550 and has an operating handle 545. This sash is moveable from a fully closed position as is illustrated in FIG. 11, to fully open position as illustrated in FIG. 12. As in FIGS. 1 to 7 header 541 and sill 542 parts of the outer frame contains tracks T for the movement of the draw bars 552, 552' of screens S and S' and engaged thereof within multiple detents D provided in the tracks T. The roll out blind S' extends from a fully retracted position inside left jamb 544 to fully extended position beside right jamb 543. Alternatively the blind S' may be stopped in any of the detent locations shown. Likewise the bug screen S can be extended from the screen cassette 551' disposed inside the pocket of right jamb 543 to a fully extended position. The window illustrated in FIGS. 11, 12, 13 and 14 include a moveable sash having frame members 556, 557, 558 and 559. Both front and back sashes may be locked in position by the operation of cam lock 546 as best seen in FIG. 14.

Figure 15:
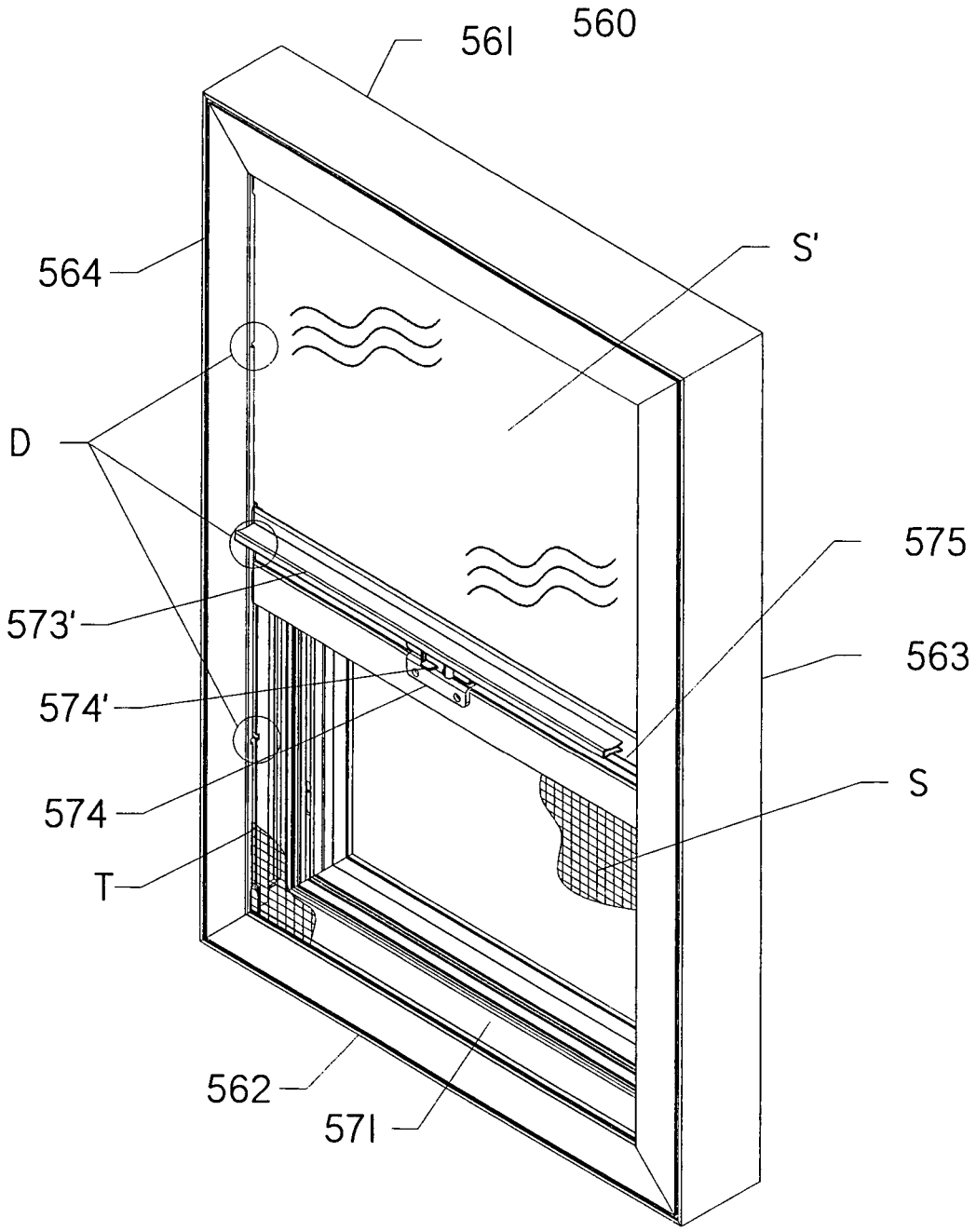
FIGS. 15, 16 and 17 are schematic perspective views of operational modes of a single hung window with two roll out assemblies and illustrated in a preferred embodiment of the invention.
Figure 16:
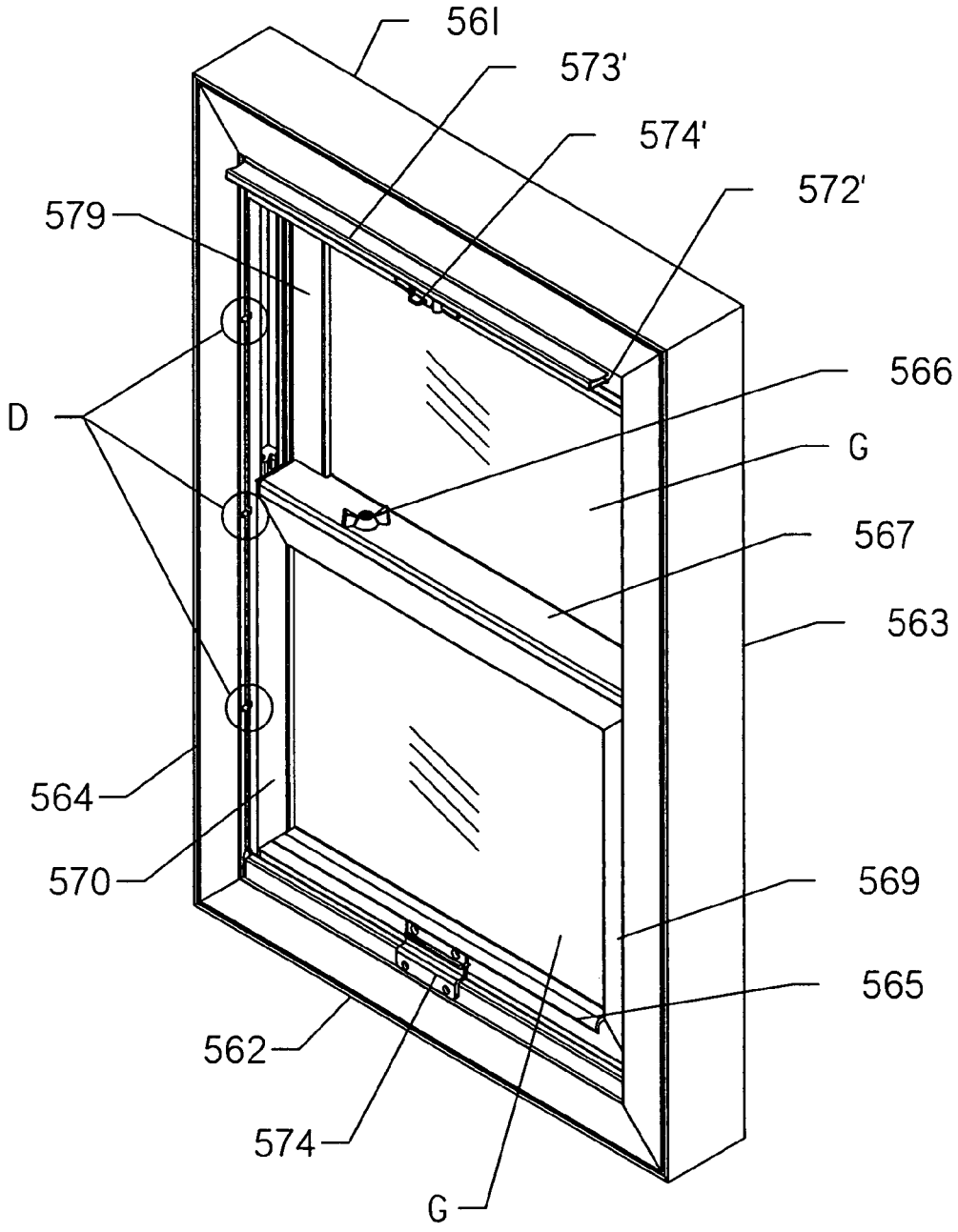
Figure 17:
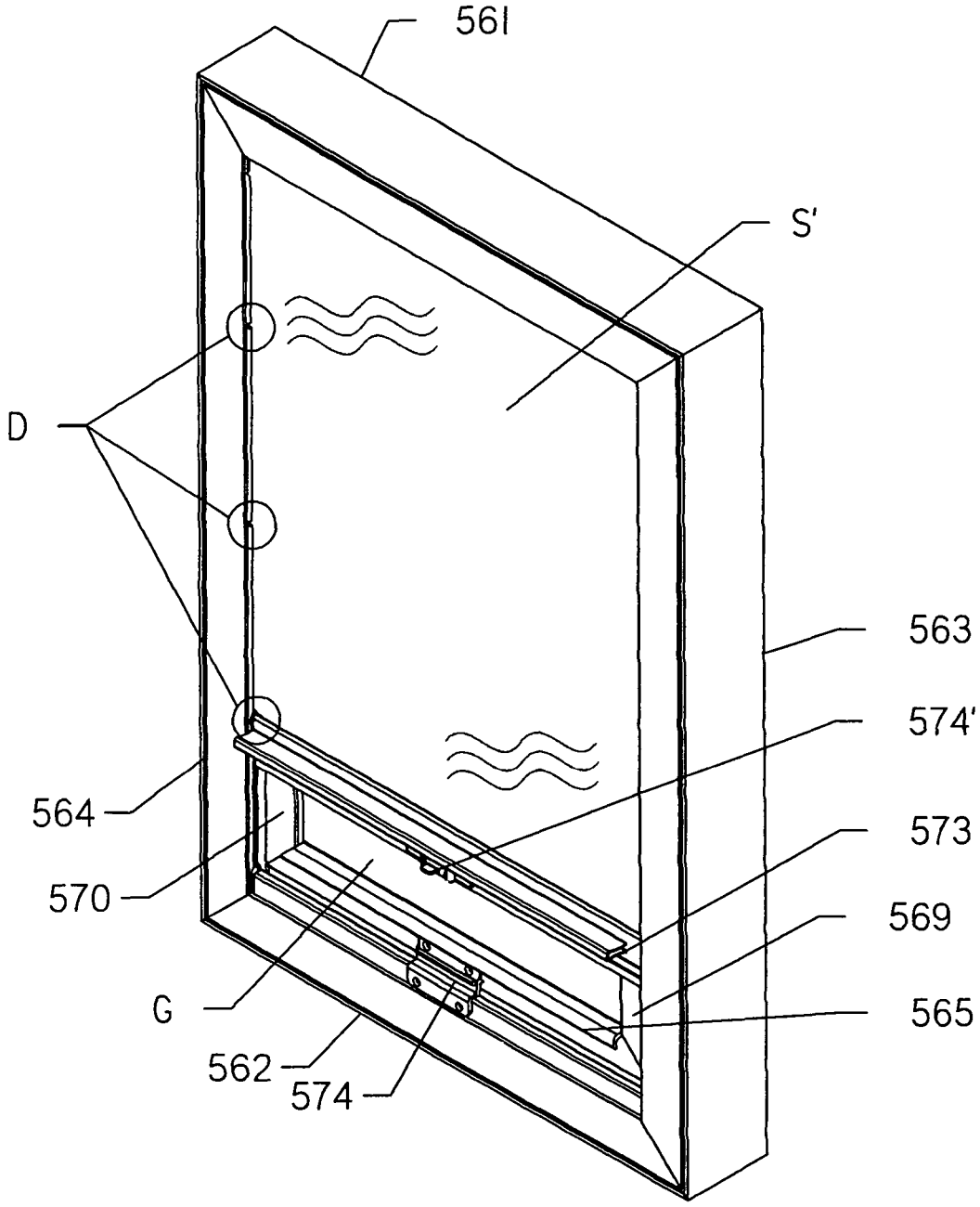
Figure 18:
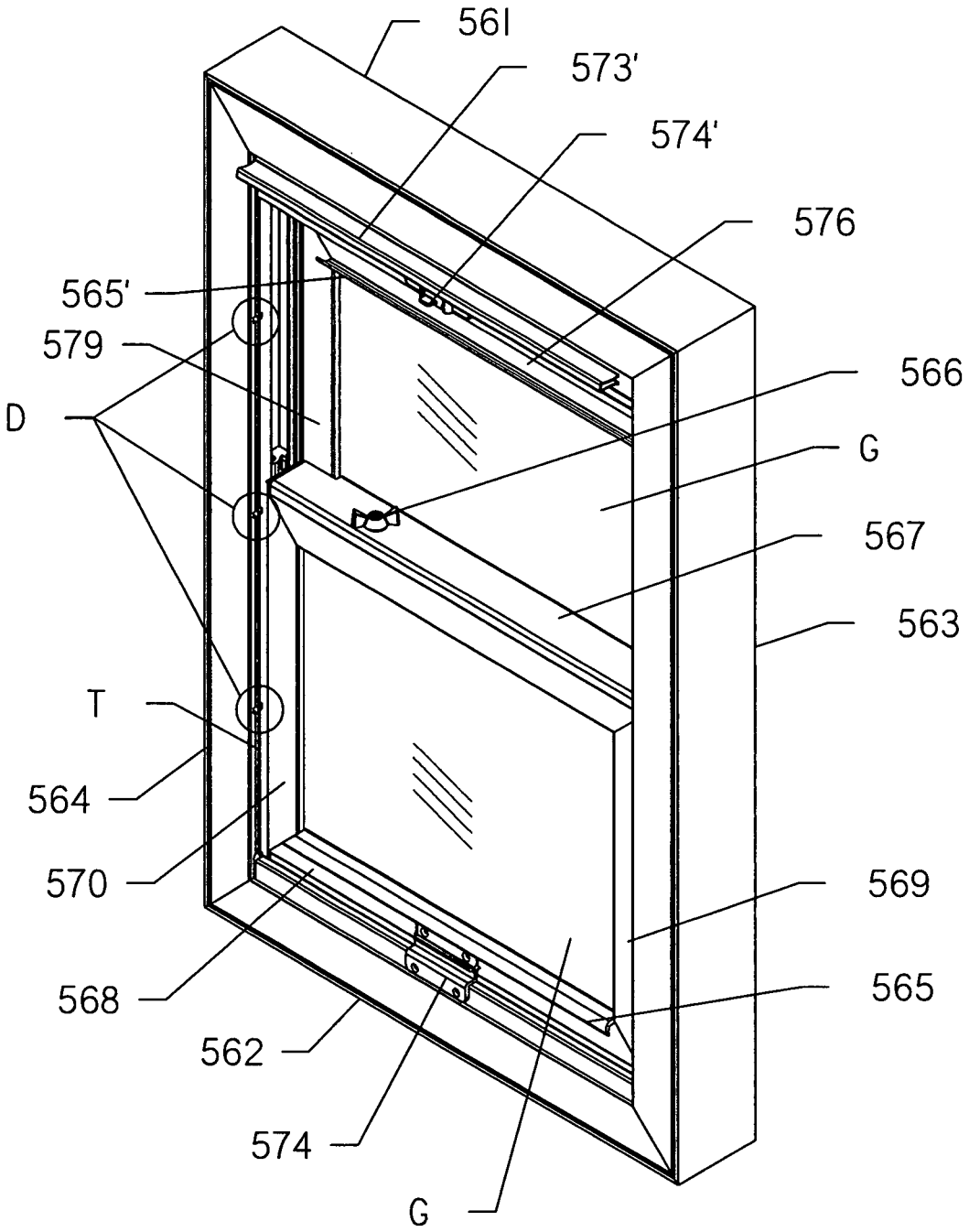
FIGS. 18 and 19 are schematic perspective views of operational modes of a double hung window with two roll out assemblies and illustrated in a preferred embodiment of the invention.
Figure 19:
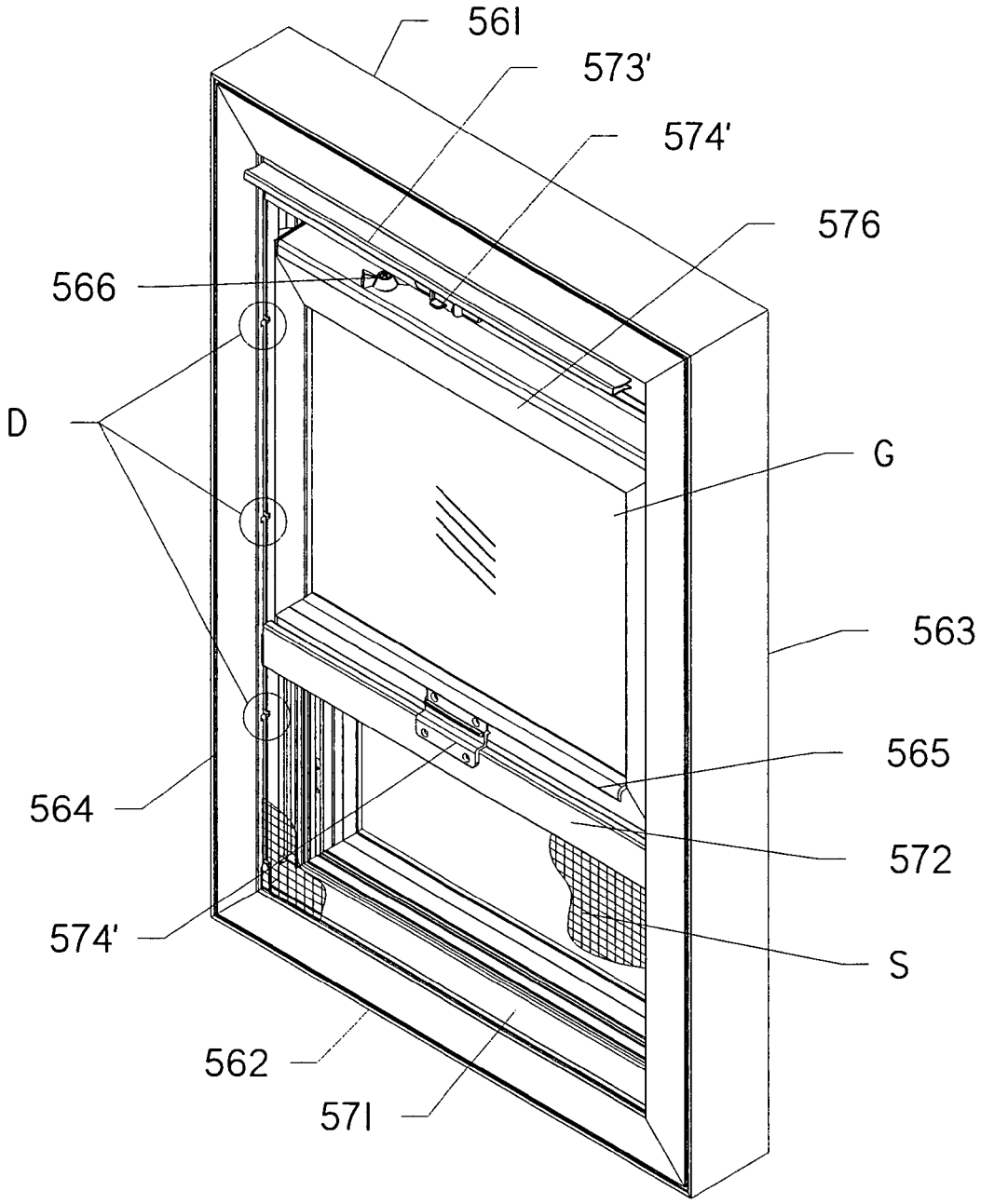

FIGS. 15, 16 and 17 illustrate a single hung window embodying the invention while FIGS. 18 and 19 illustrate a double hung window embodying the invention. Each window 560 has an outer frame consisting of header 561, sill 562, right jamb 563 and left jamb 564 and includes two sashes, a front sash with frame members 567, 568, 569 and 570 and a back sash with frame members 576, 577, 578 and 579. In FIGS. 15, 16 and 17 the back sash is stationary while in FIGS. 18 and 19 the back sash is also moveable.

Referring now to FIG. 16 it is clear that tracks T are located on the right jamb 563 and left jamb 564. Further pockets P containing screen/blind cassettes 571 and 571' are located in the header 561 and sill 562. The blind S' extends from the screen cassette 571' by operating the draw bar 572', by means of handle 573', from a fully retracted position shown in FIG. 16 to a partially extended position illustrated in FIGS. 15, and 17. The bug screen S is engaged with the front sash by the means of a latch operator 574. The screen S or S' extends from a fully retracted position as illustrated in FIG. 16 to a fully extended position shown in FIG. 15.

Now referring to FIG. 18 both sashes are moveable up and down in relation to one another once unlocked by the means of a sash handle such as 565'. The two sashes may be locked by the cam lock 566. FIG. 19 illustrates bug screen S extending from screen cassette 571 and connected to sill 568, when the sash is fully open and the blind S' is fully retracted into the screen cassette 571'.

Figure 20:
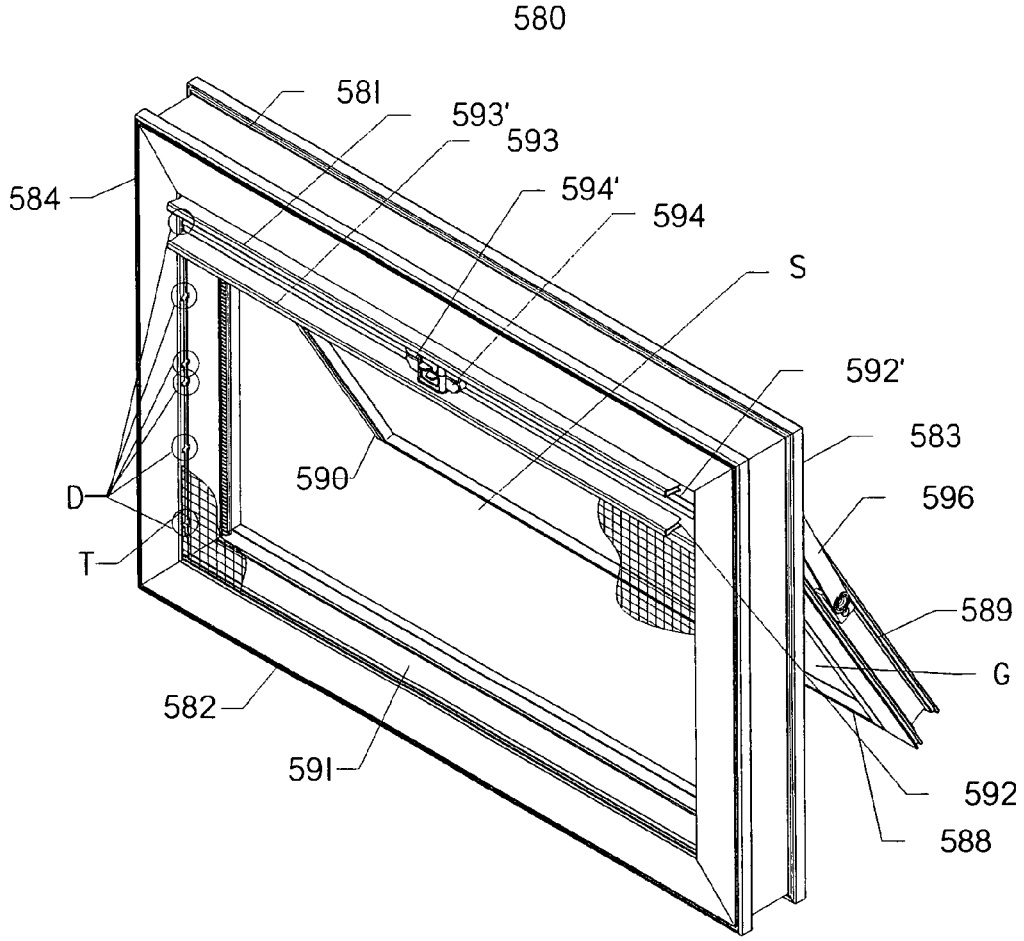
FIGS. 20 and 21 are schematic perspective views of operational modes of an awning window with two vertically operating roll out assemblies and illustrated in a preferred embodiment of the invention.
Figure 21:
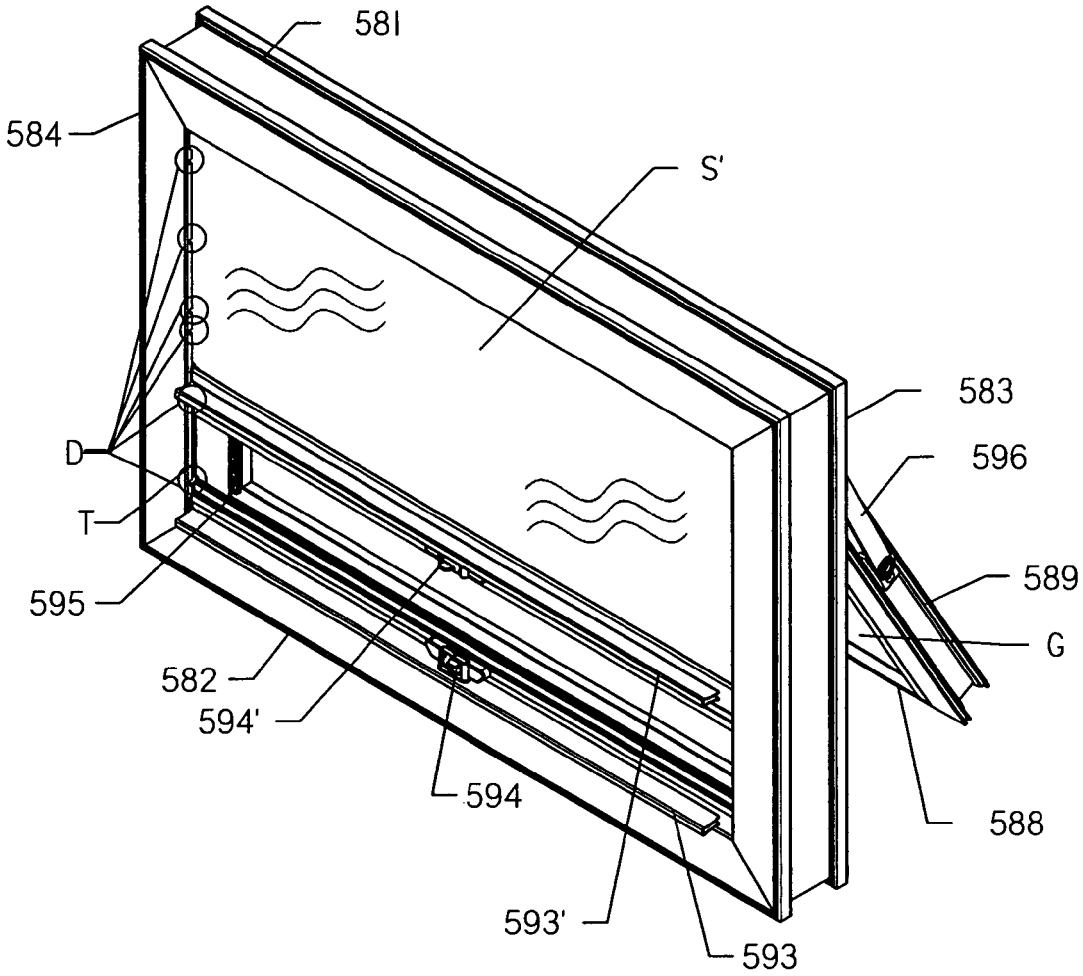
Figure 22:
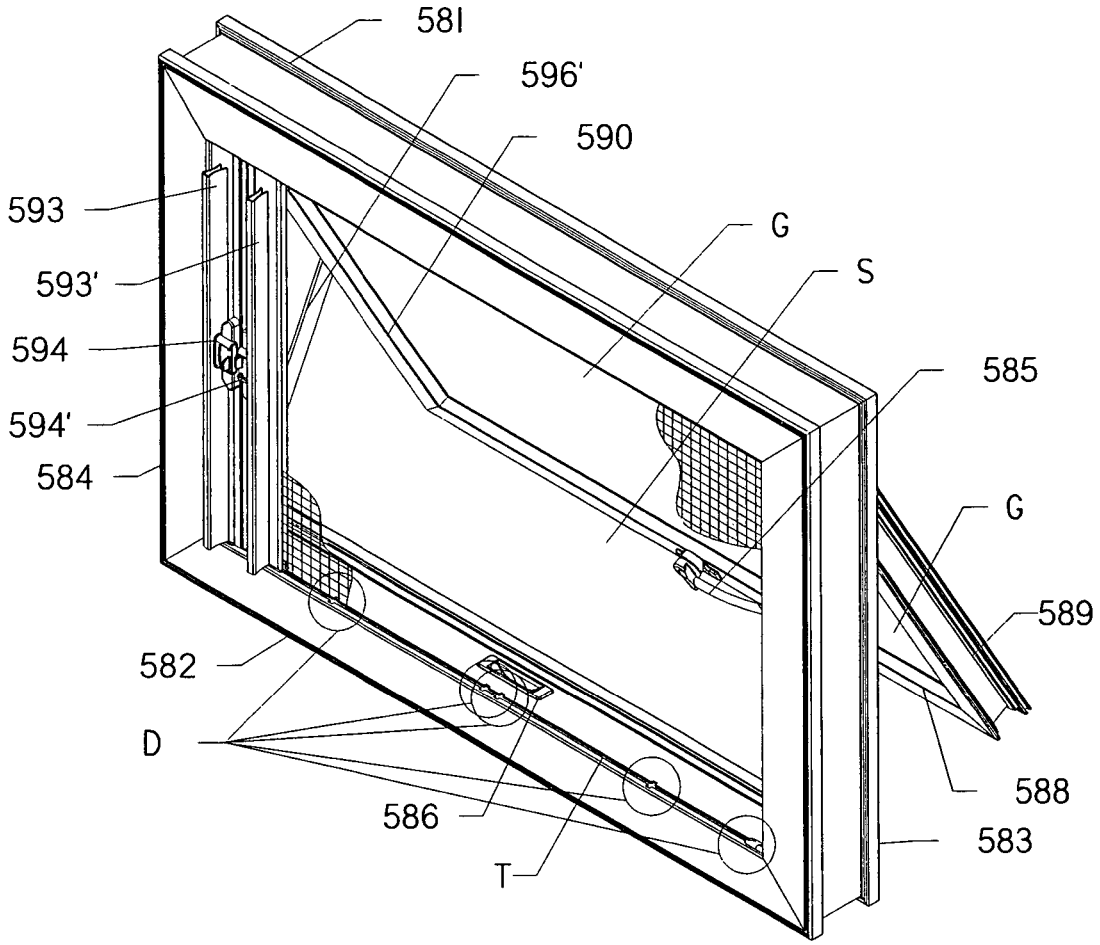
FIGS. 22 and 23 are schematic perspective views of operational modes of a second awning window with two horizontally operating roll out assemblies and illustrated in a preferred embodiment of the invention.
Figure 23:
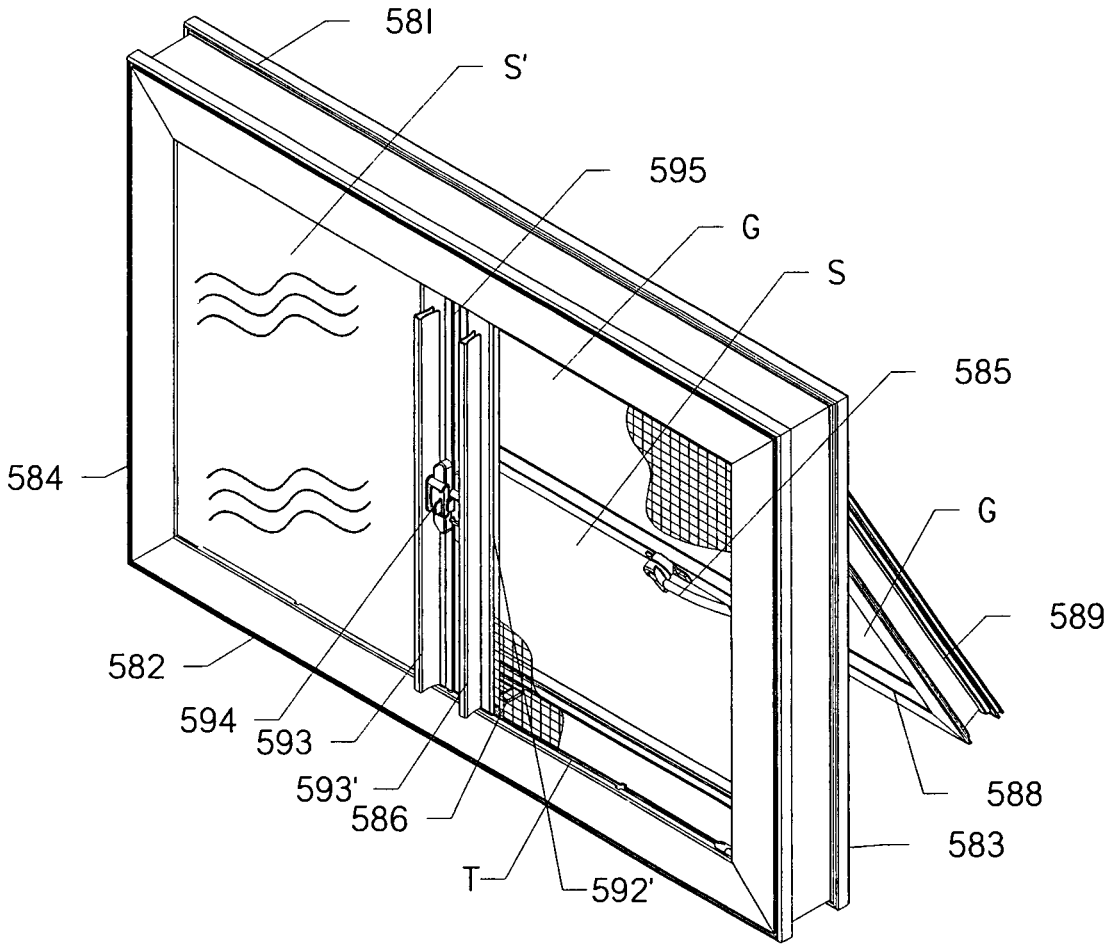

Referring to FIGS. 20, 21, 22 and 23 there is illustrated an awning window in various embodiments of the invention. FIGS. 20 and 21 illustrate rollout assemblies moveable in vertical directions from the top and bottom portions of the window whilst FIGS. 22 and 23 depict windows while rollout assembly movable in horizontal directions.

Referring to FIG. 20 window assembly 580 has an outer frame which includes header 581, sill 582, right jamb 583 and left jamb 584 and a sash including frame members 587, 588, 589, 590 and a pair of brackets 596 which allows pivoting of the sash from the window frame. The sash lock 586 and the sash handle 585 are best illustrated in FIG. 22, to move the window from a locked position to an open pivoted position.

Referring now to FIG. 20 sill 582 has a pocket P that contains screen cassette 591 with the bug screen S. FIG. 20 illustrates bug screen S fully extended from the cassette 591 to the header 581 of the window where it is engaged by draw bar 592'. In this embodiment of the invention the tracks T are located on the right and left jambs 583 and 584 of the awning window. These tracks T have multiple detents D which provide multiple stops for the blind or screen.

Referring to FIG. 21 bug screen S is fully retracted into cassette 591 while the blind S' is partially extended from its cassette 591' toward the bottom part of the window. As in previous embodiments there are number of multiple positions for both rollout assemblies S and S' forfully extended, fully retracted, and partially extended positions whereat track detents are engaged. Both draw bars 592 and 592' are equipped with draw bar handles 593 and 593' and latch operators 594 and 594' which allows the engagement of the draw bar pins with the detents D of the tracks #. On the leading edge of each draw bar there are provided bug seals 595 which contact one another when the draw bars engage. In the alternative embodiments of the invention illustrated in FIGS. 22 and 23 the pockets with the cassettes are located in the left jamb 584 and right jamb 583 of the assembly and the tracks T including detents D are located in the header and sill parts of the window frame 581 and 582.

Figure 24:
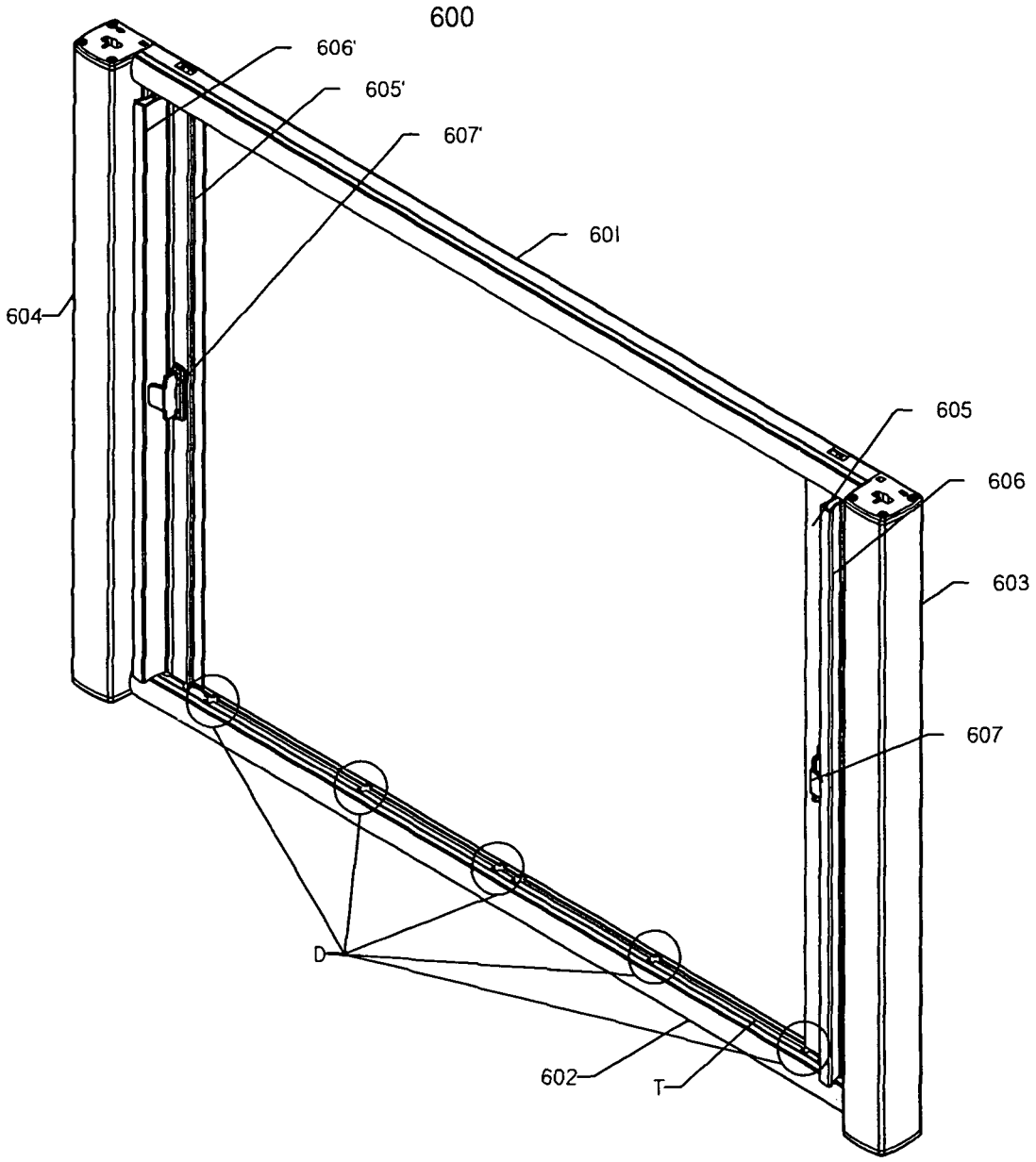
FIGS. 24, 25, 26 and 27 are schematic perspective views of operational modes of a replacement screen frame with roll out assemblies positions on each siding and illustrated in a preferred embodiment of the invention.
Figure 25:
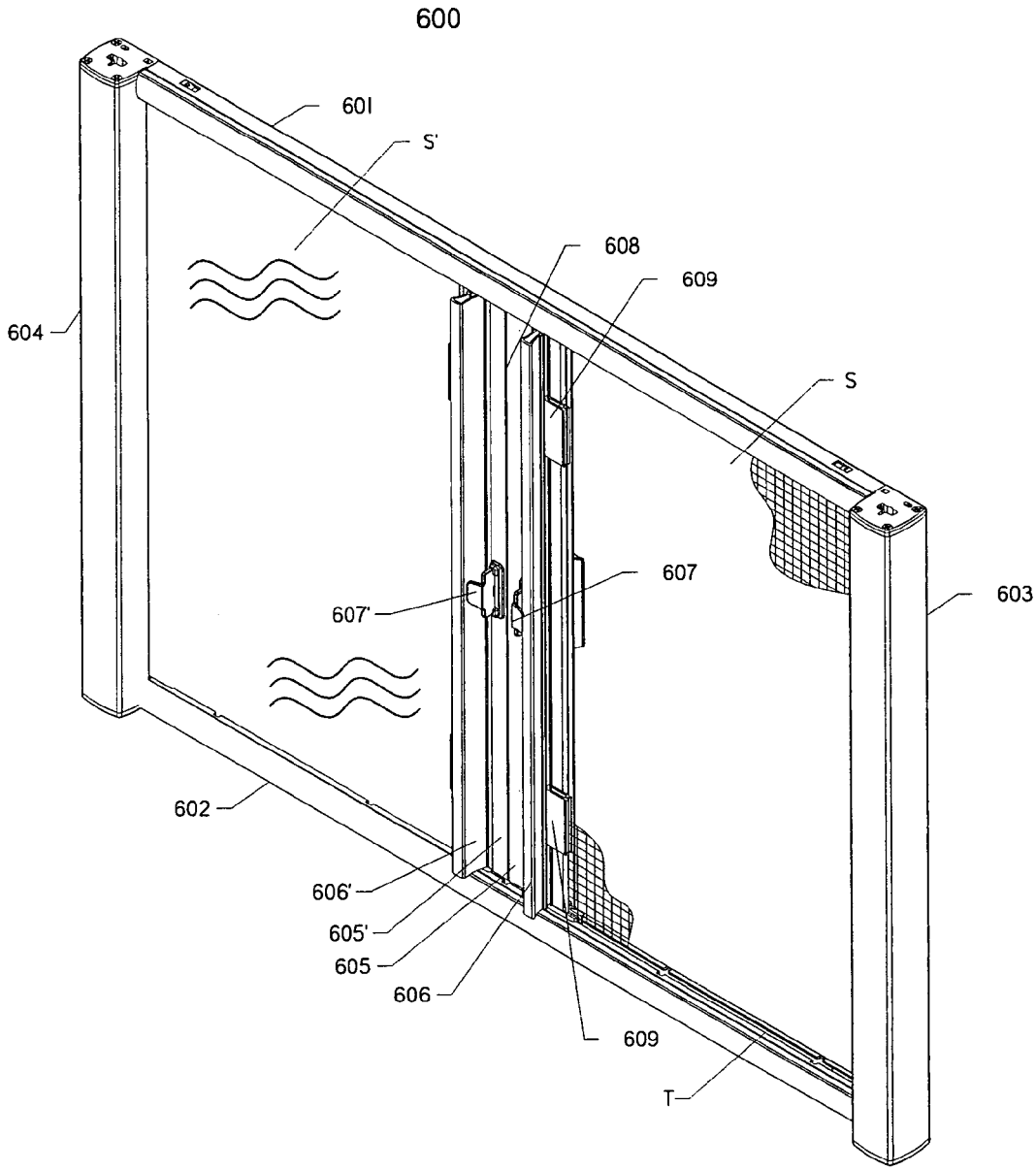
Figure 26:
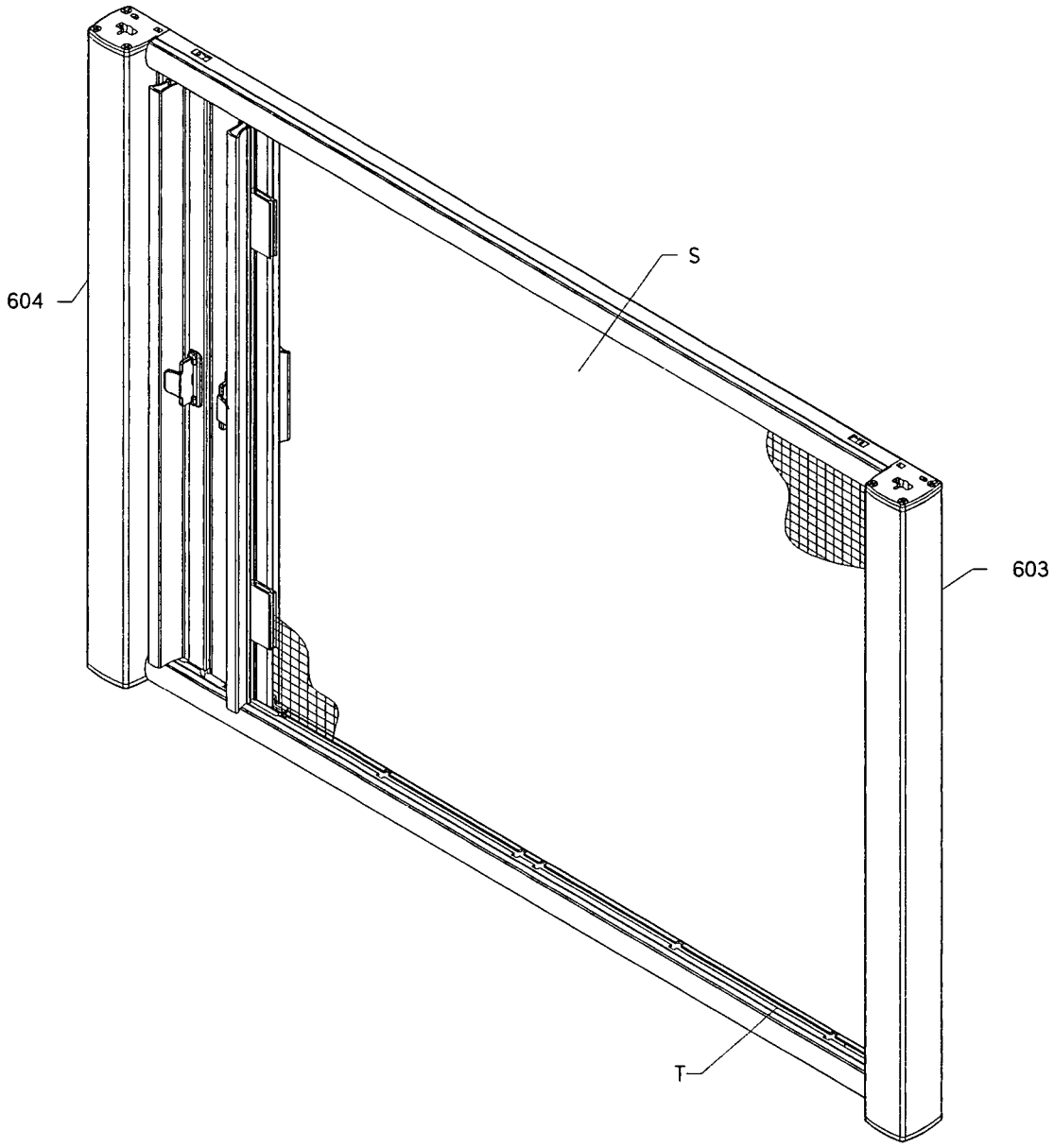
Figure 27:
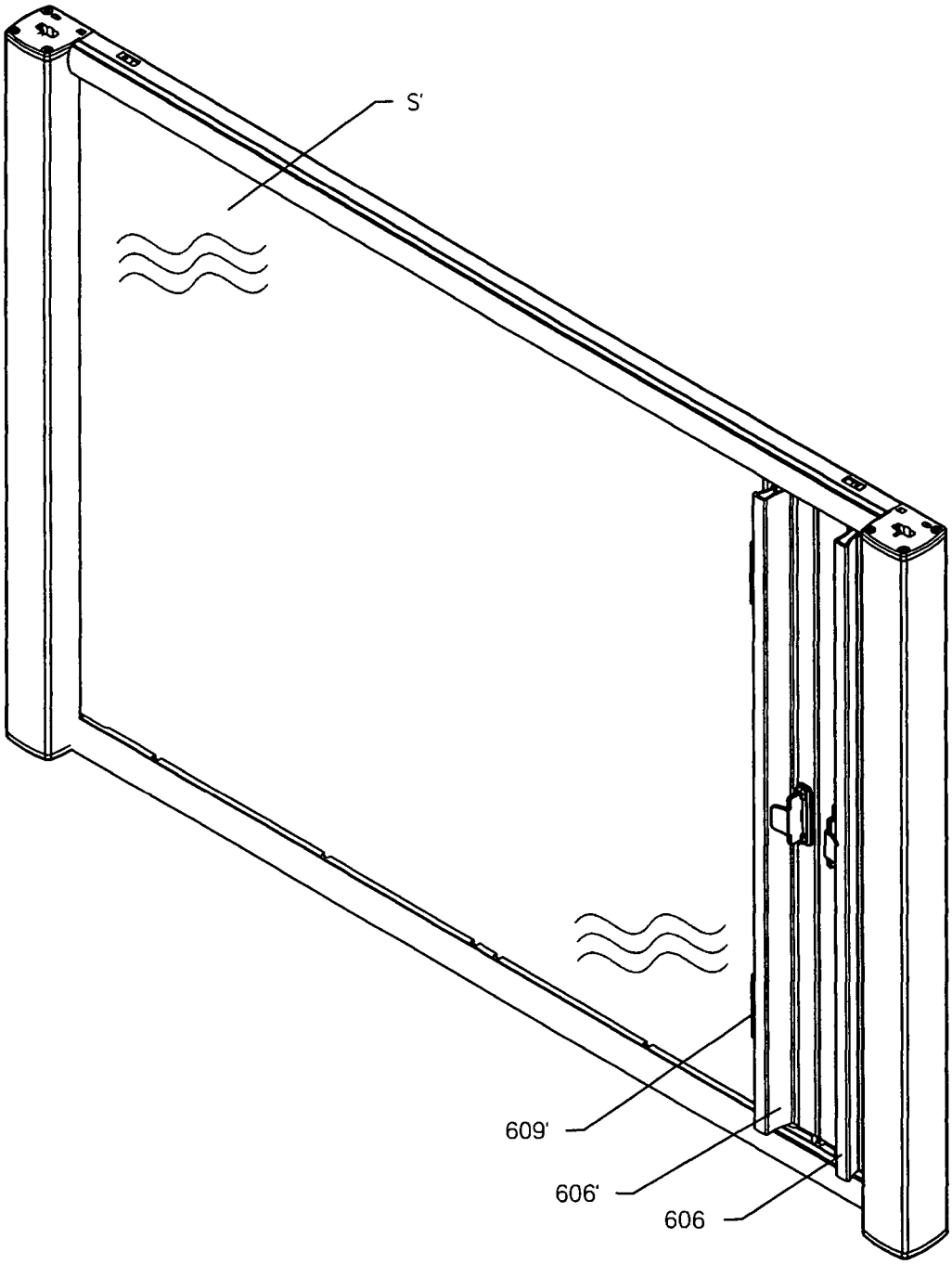

FIGS. 24, 25, 26 and 27 illustrate a replacement screen frame assembly. Therefore the assembly 600 has a top frame member 601 a bottom frame member 602, a right housing 603 and left housing 604. Housing 603 contains a rollout bug screen assembly S and the housing 604 contains a rollout blind assembly S'. The bug screen assembly S illustrated in FIG. 25 includes a draw bar 605, draw bar handle 606 and a latch operator 607. It also contains a bug seal 608 on the leading edge of the draw bar and additional stoppers 609 that prevent jamming of the draw bar inside the cassette housing 603 when retracted. The top and the bottom frame members shown in FIG. 24 include tracks T for the movement of rollout assemblies including multiple detents D providing predetermined stop positions for the rollout assemblies. As mentioned previously the roll out assemblies operates in various modes, for example; a fully retracted position as illustrated in FIG. 24, a partially extended position near the central part of the screen frame as illustrated in FIG. 25. The bug screen S is shown fully extended from the cassette 603 adjacent the housing part 604 as best seen in FIG. 26. Blind S' is fully extended from the housing 604 adjacent the housing 603 as best seen in FIG. 27. In this position the bug screen S is fully retracted into the housing 603. Either rollout assembly might be operated to and from an intermediate position along the track of the screen frame assembly. The engagement with track T of the rollout assemblies at various positions along the tracks functions in the same manner as described and illustrated in relations to FIG. 8.

An assembly for replacement screen frames might be installed with previously described closure assemblies such as doors or windows. The following are examples for the use of such a screen frame embodied with various door assemblies such as a French door, an entry door and a patio door. These examples are illustrative only and are not to be considered as limiting the scope of the invention.

Figure 28:
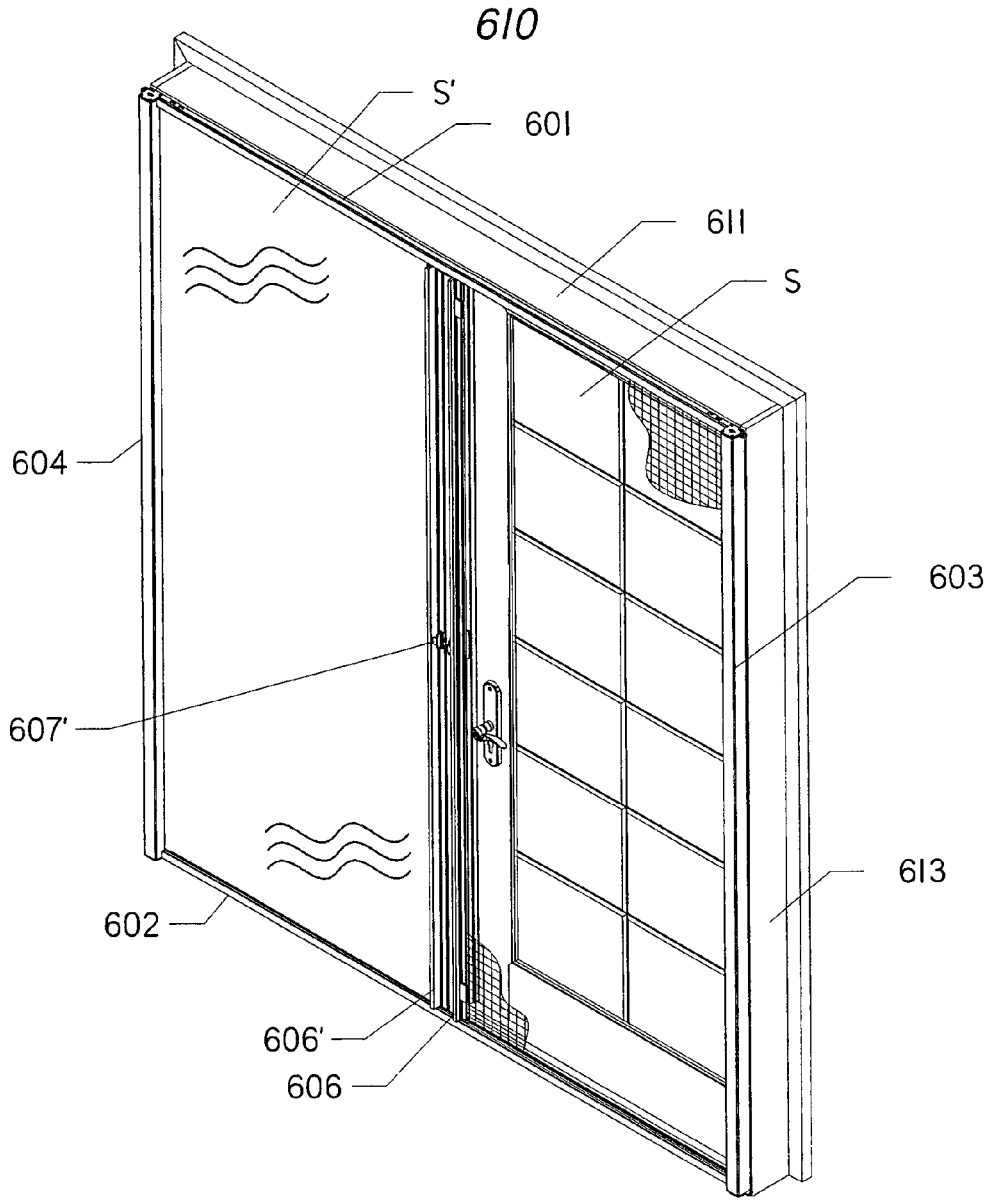
FIGS. 28, 29 and 30 are schematic perspective views of a French door assembly with the screen frame of FIG. 24 shown in various operational modes, and illustrated in a preferred embodiment of the invention.
Figure 29:
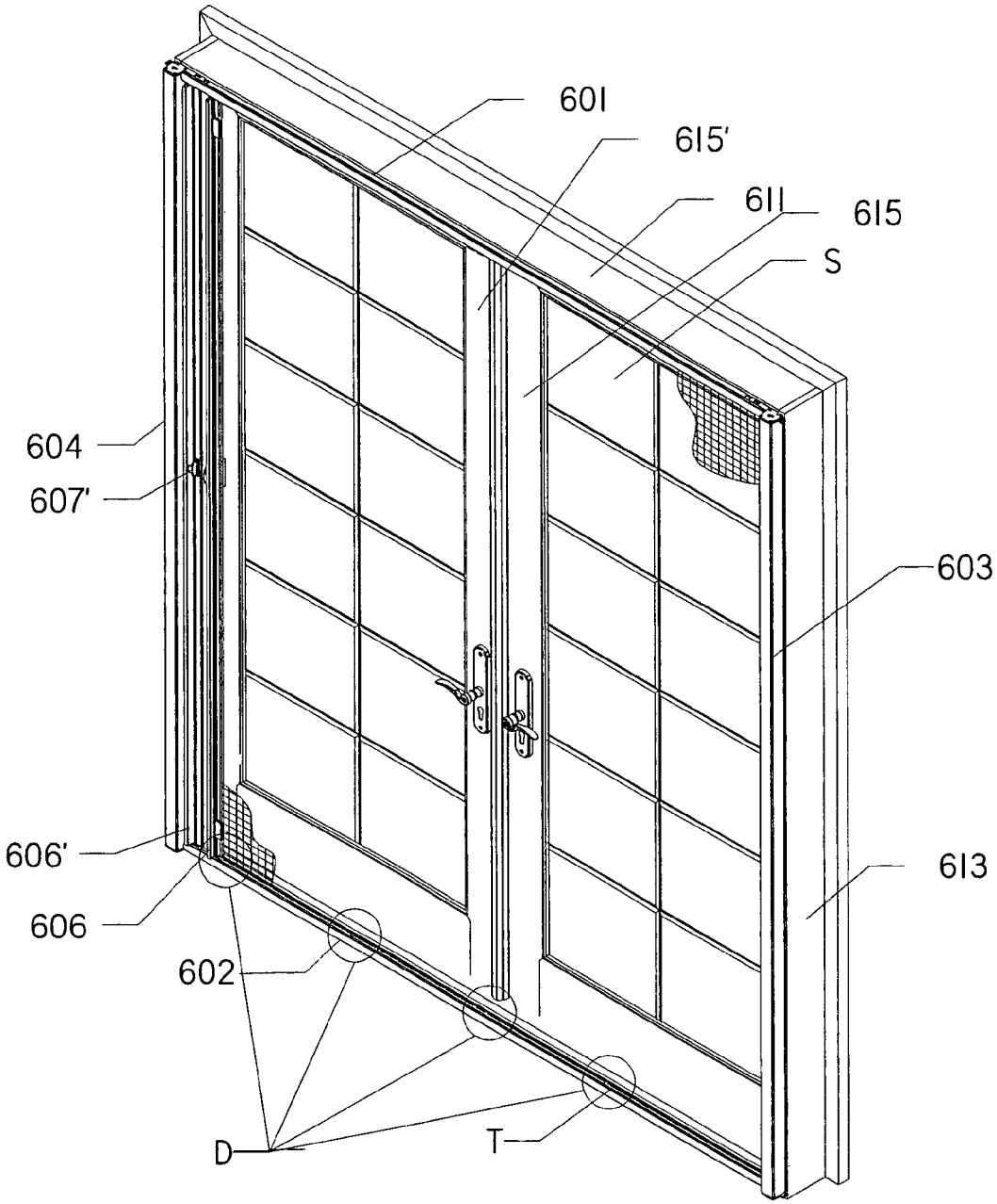
Figure 30:
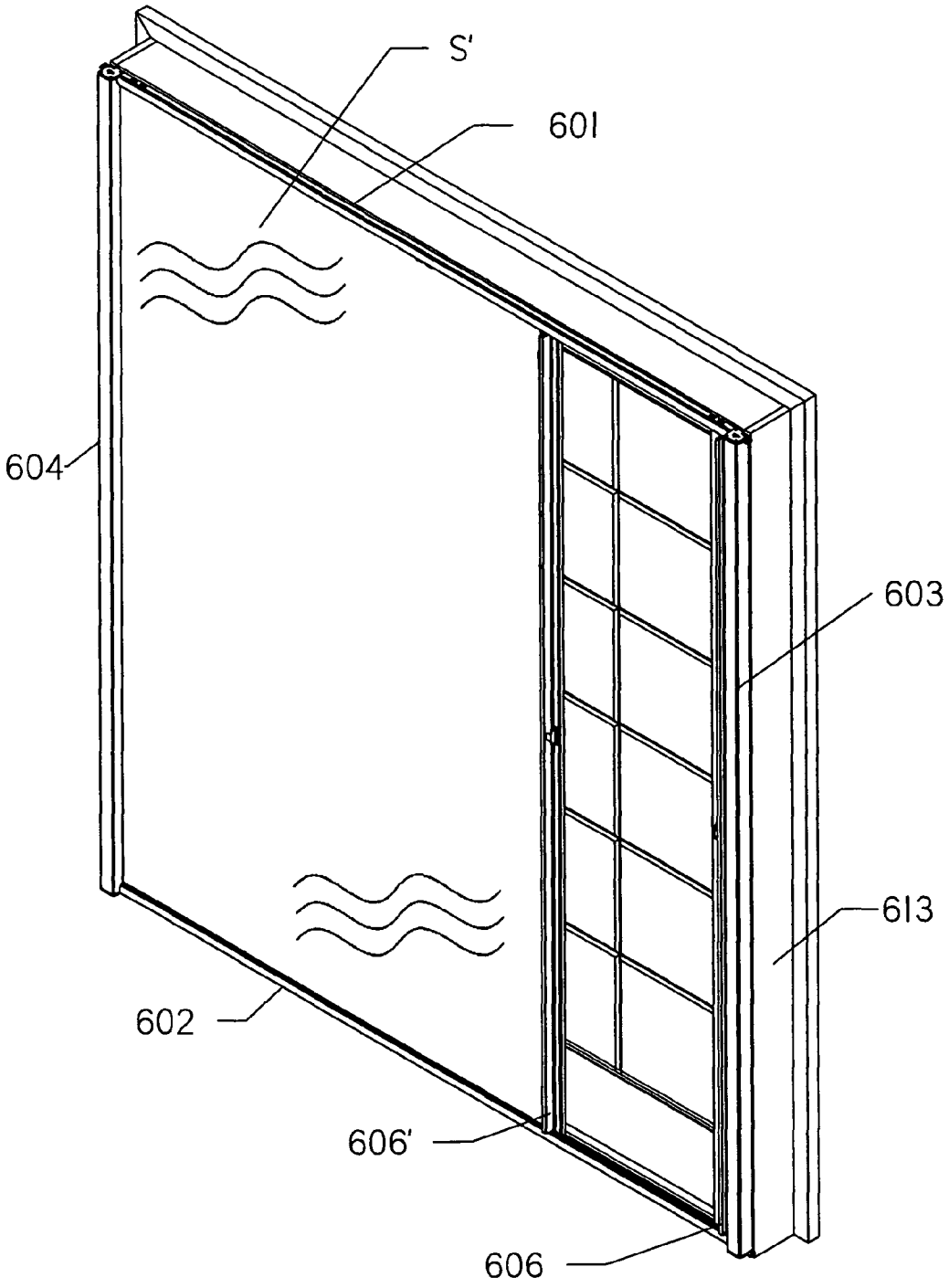

In FIGS. 28, 29, and 30 a replacement or add on screen assembly is illustrated attached to the frame of a French door assembly. The French door assembly contains an inside frame which consists of a header 611, seal 612, right frame member 613 and left frame member 614. The screen frame previously illustrated in FIGS. 24 to 27, is shown attached to the inside surface of the French door assembly frame. In a similar manner to the embodiment with a window assembly, the screen frame attached to the French door assembly may operate in various modes. For example, FIG. 28 shows a partial extension of the blind S' from the left housing to the center of the assembly with the bug screen S being partially extended from the right housing 603 to the center of the assembly. FIG. 29 illustrates the bug screen S fully extended from the housing 603 to the left side of the door assembly. FIG. 30 illustrates partial extension of the blind S' from the housing.

Figure 31:
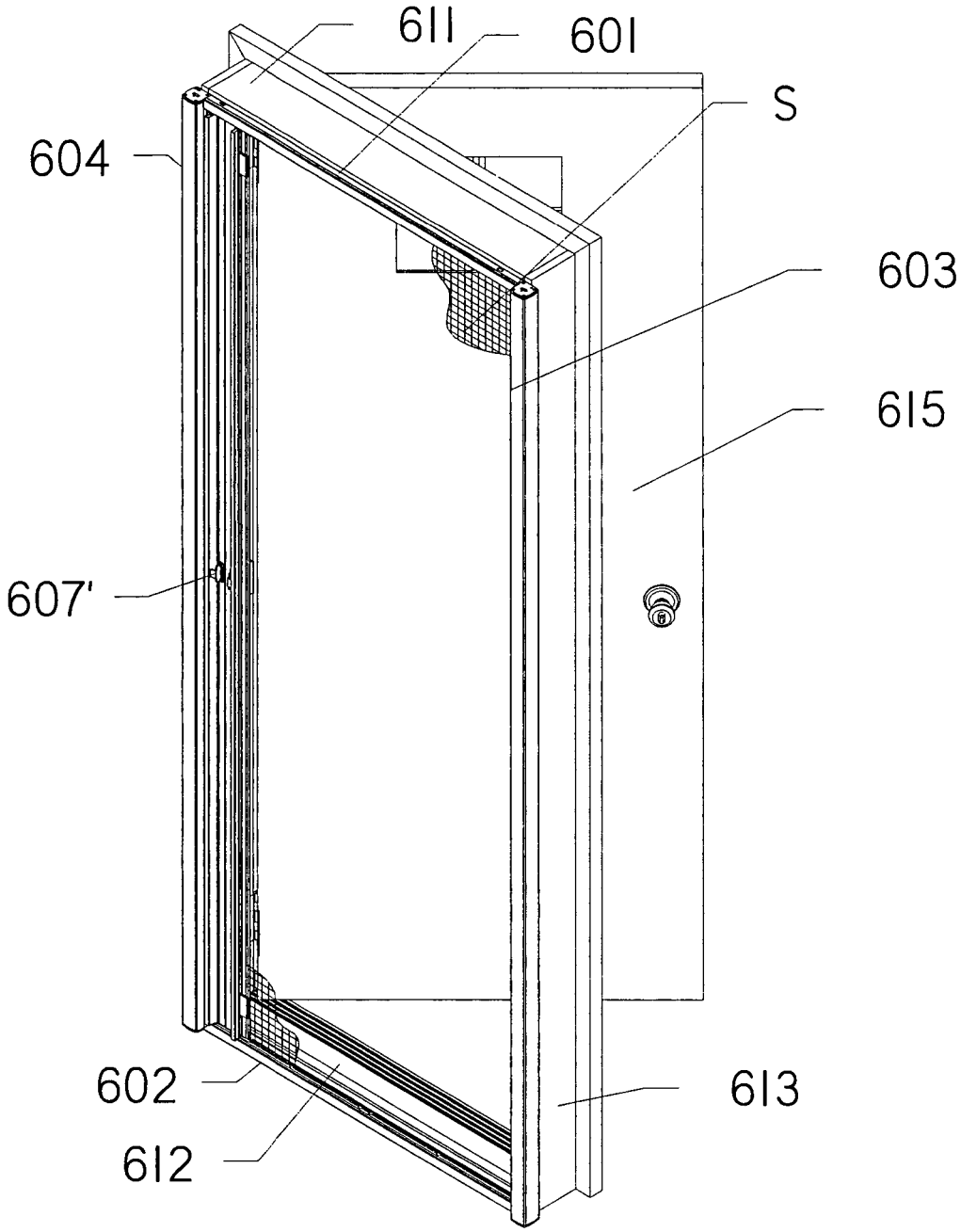
FIGS. 31 and 32 are schematic perspective views of an entry door assembly with a screen frame similar to FIG. 24.
Figure 32:
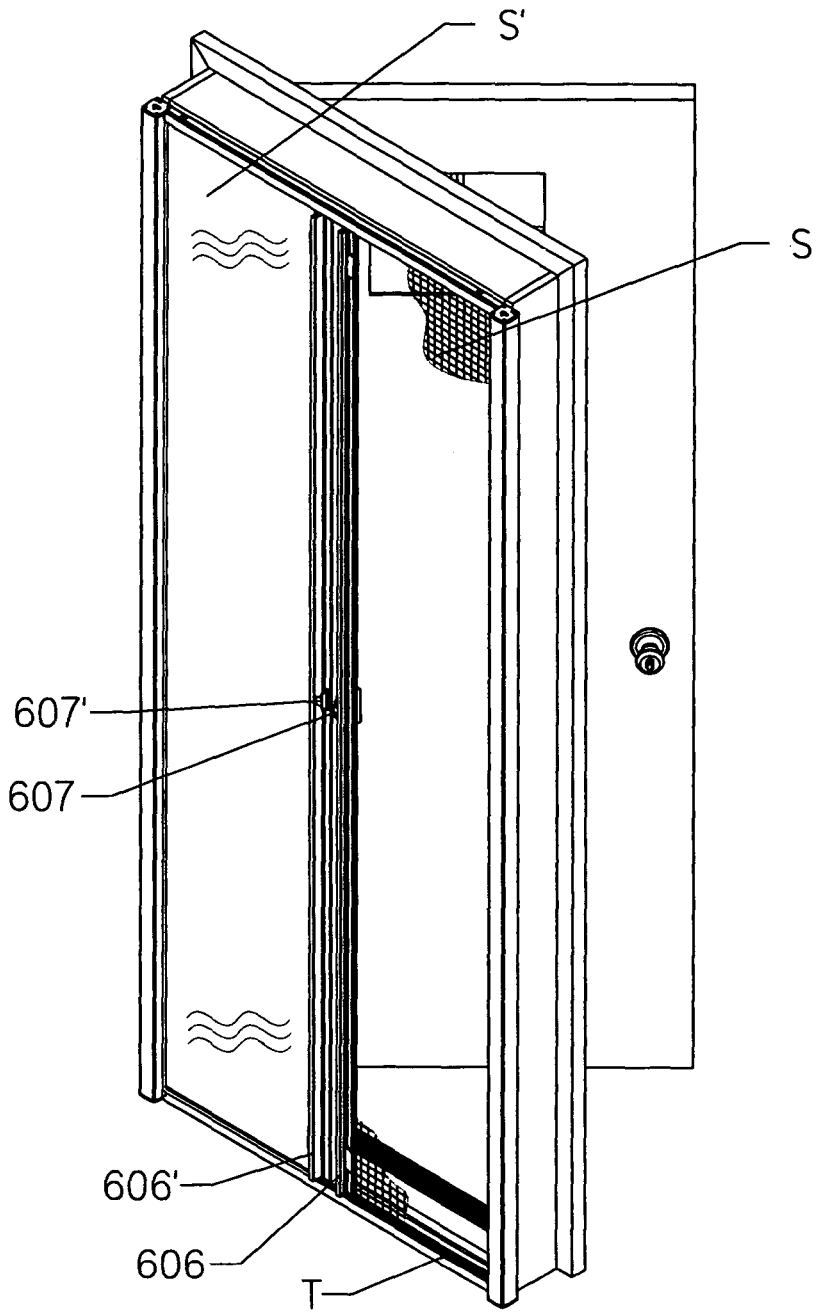
Figure 33:
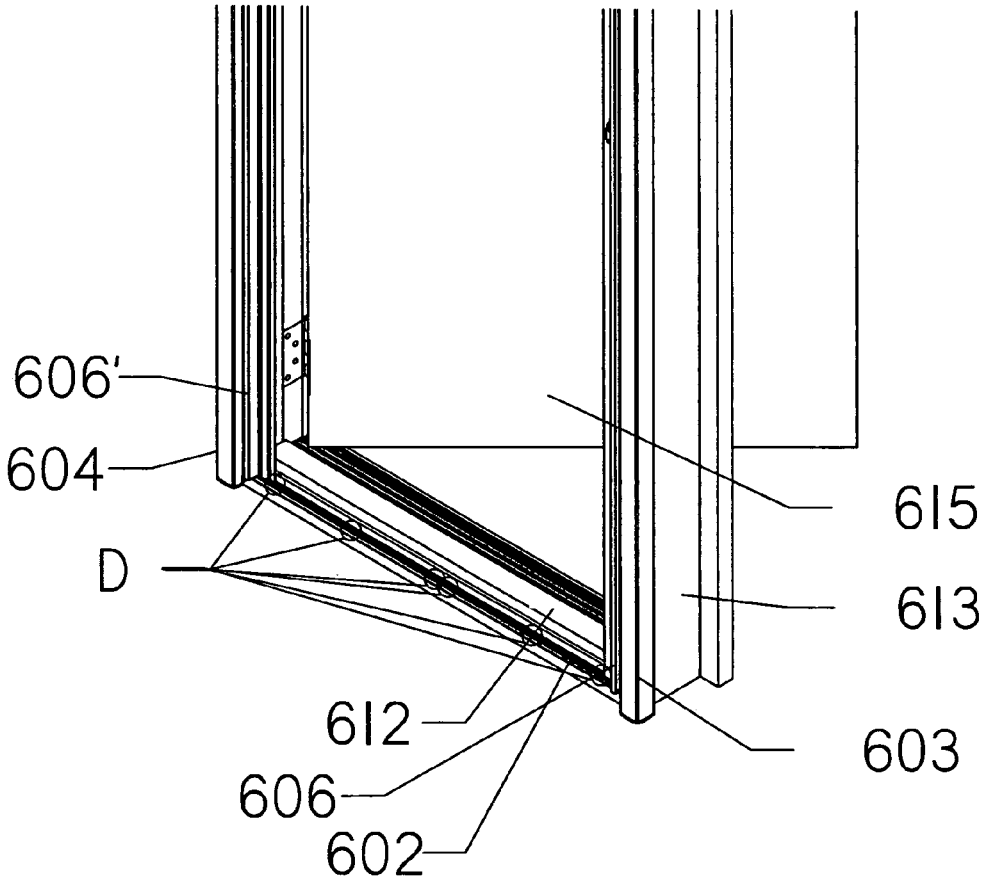
FIG. 33 is a schematic perspective isolated view of the sill of the assembly of FIG. 31 illustrating detents locations which act as stop position for the draw bar of a roller assembly, and illustrated in one embodiment of the invention.

In yet another embodiment of the invention, the screen frame may be attached to the entry door assembly as shown in FIG. 31. FIGS. 31 and 32 therefore illustrate an entry door with an add onscreen assembly similar to the French door embodiment. The add on screen assembly is thereof attached to an entry door frame containing header 611, seal 612, right frame member 613 and left frame member 614 and entry door 615. FIG. 33 illustrates the detents D positioned on the bottom frame member of the screenless screen. Again as in previous embodiments the add on screen frame assembly operates in various modes. For example in FIG. 31 the screen is fully extended from the housing 603 toward the left part of the assembly and in the FIG. 32, both rollout assemblies are partially extended from the housing.

Figure 34:
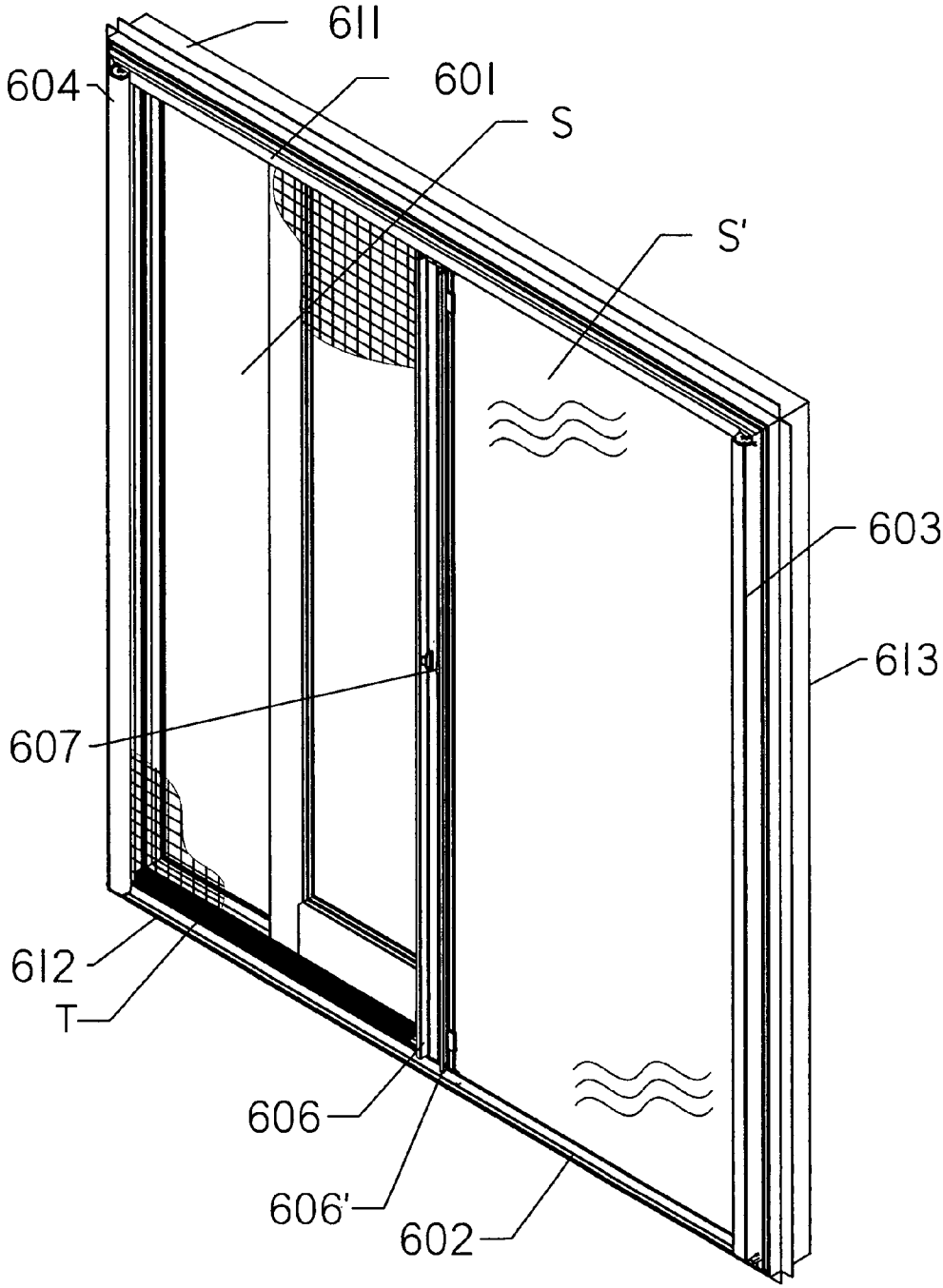
FIGS. 34 and 35 are schematic perspective views of a patio door assembly with a screen frame attachment incorporating rollout assemblies, and illustrated in a preferred embodiment of the invention.
Figure 35:
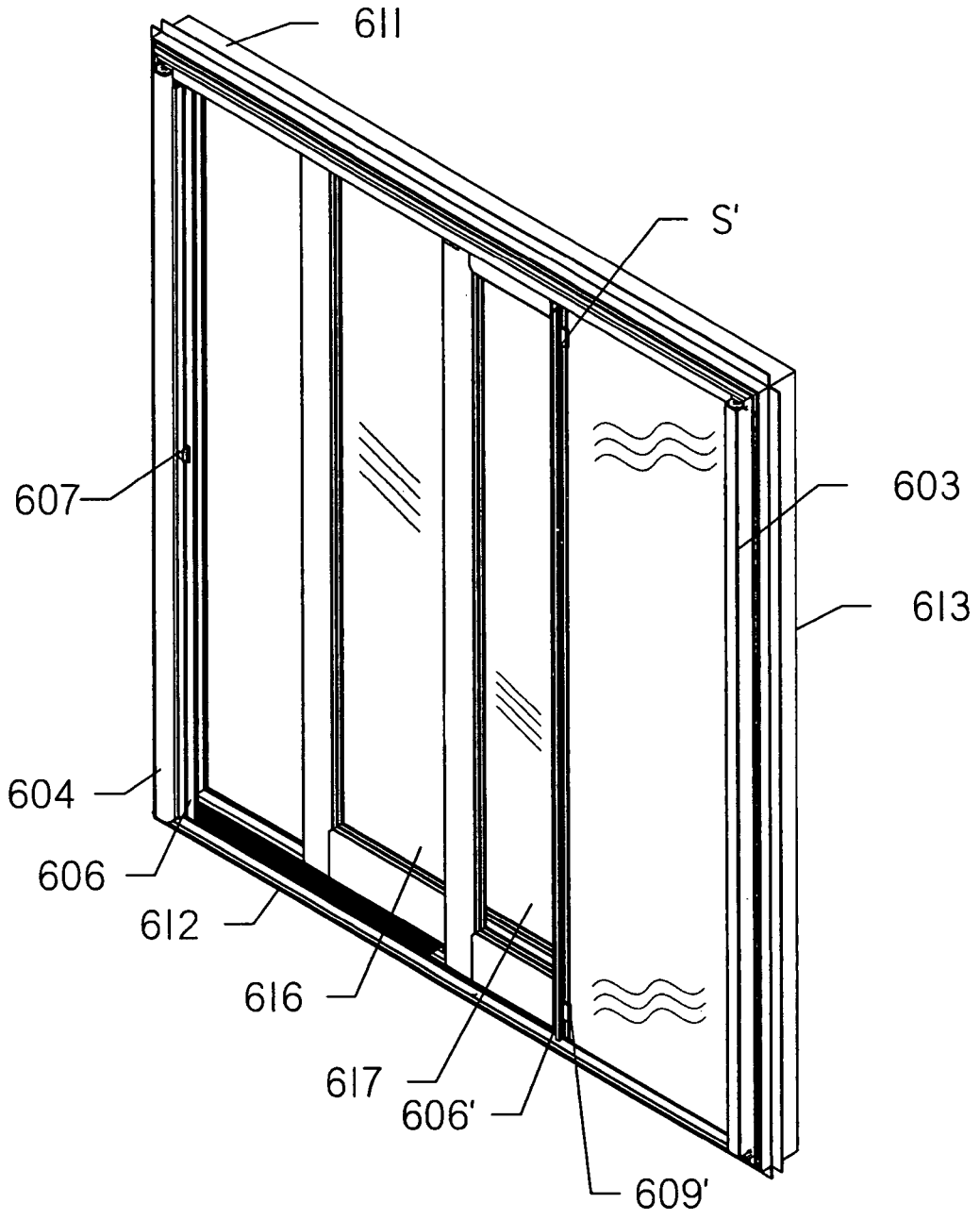

In the same manner, replacement or add on screen assemblies may be attached to a patio door assembly as illustrated in FIGS. 34 and 35. The door frame assembly illustrated includes top frame member 611, bottom frame member 612, right frame member 613 and left frame member 614 having attached there to a replacement or add-on screen assembly as described in relation to FIGS. 24 to 27. FIG. 34 illustrates the use of an add-on or replacement screen assembly with a bug screen S extending from the housing part 602 toward the center of the assembly and the blind S' extended from the housing 603 toward the center of the assembly. FIG. 35 illustrates the bug screen S fully retracted into the housing 604 and blind S' partially extended from the housing 603.

Figure 36:
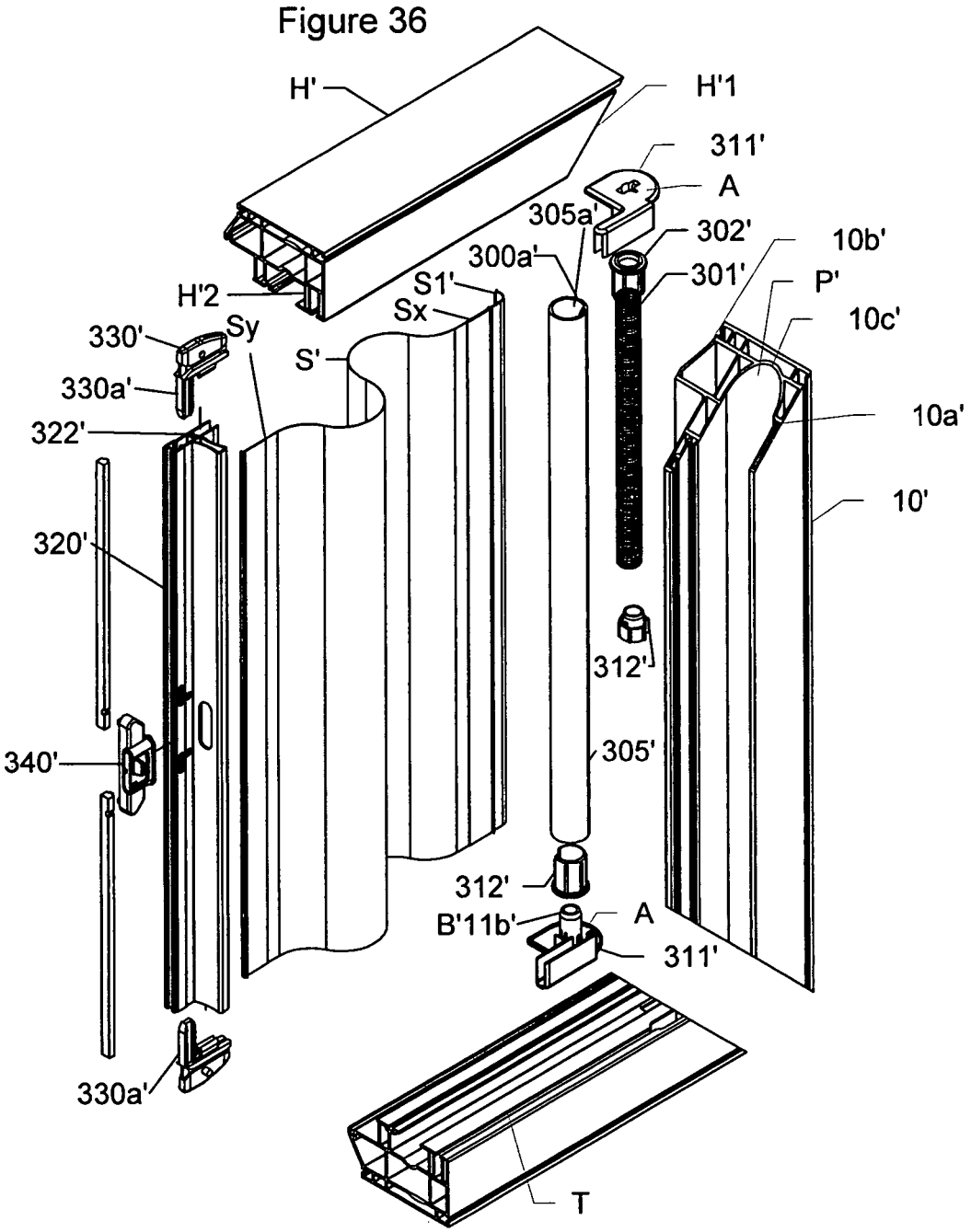
FIG. 36 is an exploded view of a screen cassette as disclosed in U.S. Pat. 6,267,168.

FIG. 36, illustrates an exploded view of a screen cassette assembly including a jamb with an integral pocket and associated parts from the header and the sill as taught in Applicant's prior patents namely U.S. Pat. No. 6,267,168 hereby in corporation by reference. However the draw bar of the current invention is different from the one illustrated in the FIG. 36 wherein parts 350'-340'-330'-320' are replaced by a new draw bar and latch operator with retractable pins shown in FIGS. 42, 44 and 45.

Figure 37:
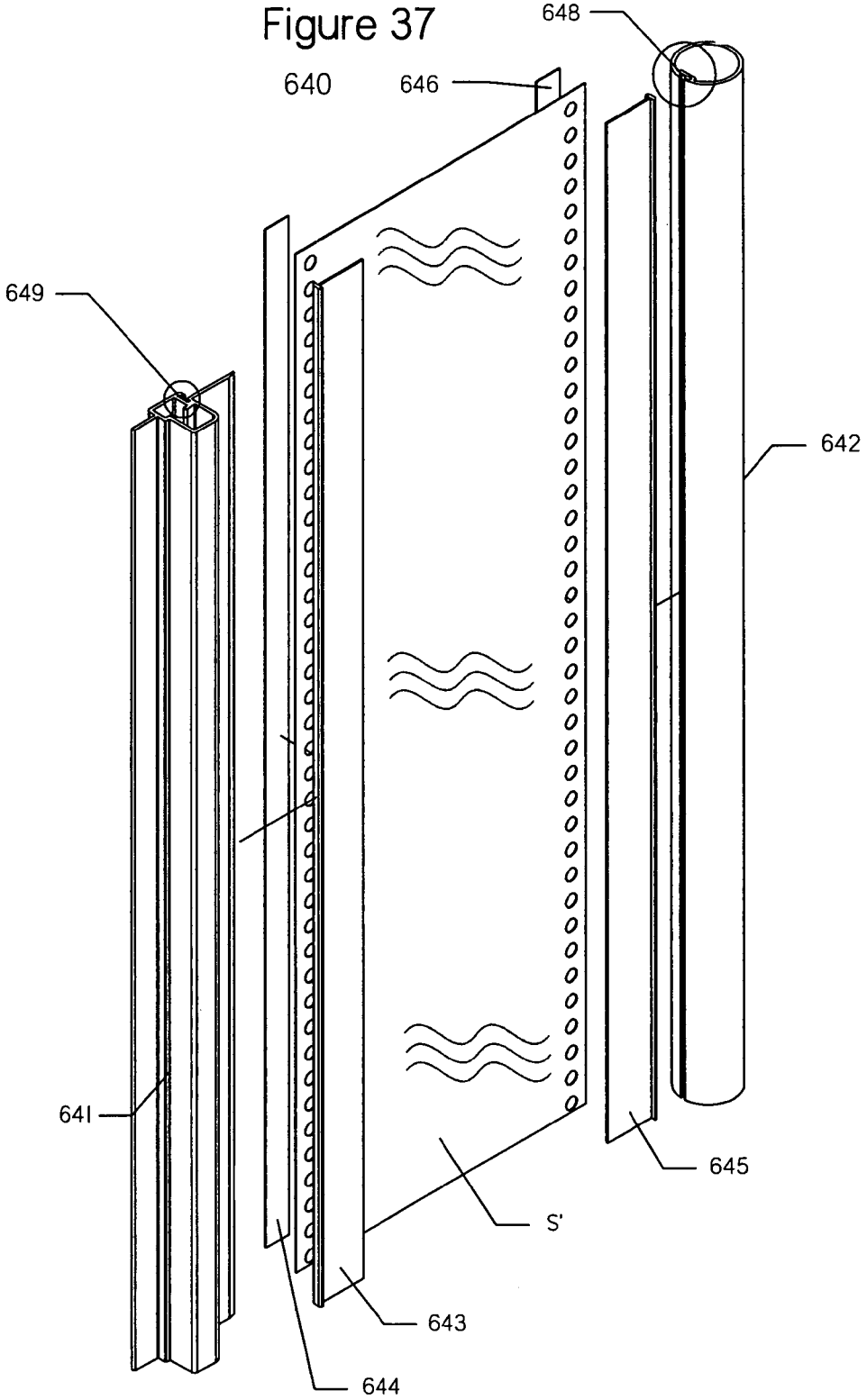
FIG. 37 is an exploded view of a blind assembly, and the technique of fastening the blind material to the flexible "T" sections and illustrated in a preferred embodiment of the invention.

FIG. 37 illustrates the assembly 640 of the blind S' with the T-shape keys 643, 645 as described in Applicant's prior patent abovementioned hereby incorporated by reference. The T-shaped keys at the end of the blind material engage with the T-shaped cavities 649, 648 of the draw bar 641 and the roller 642. As is apparent from FIG. 37 the T-shaped keys are attached to the blind material in the following manner. The blind material S' has numerous perforations along its sides, which perforation are inserted between the key members 643 and a supplementary portion 644. The blind material may be optionally perforated. However it may be attached without perforations as well. These plastic members 643, 644 and blind S' are attached by means of known welding techniques, by the application of heat or any other method known to persons skilled in the art. In this way the T-shaped keys are attached to any type of blind S' regardless the type of the material.

Figure 38:
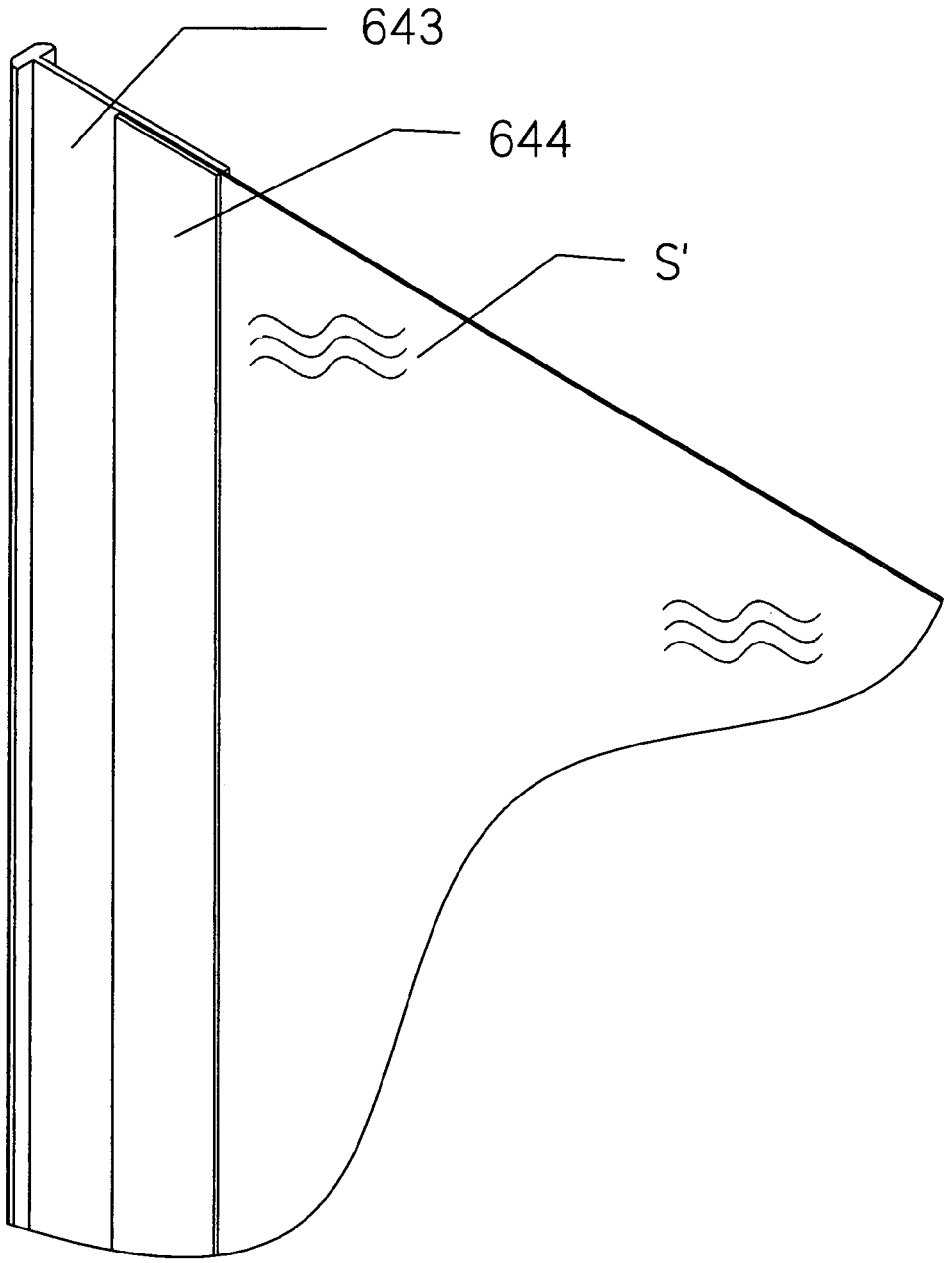
FIG. 38 is a partial perspective cut away view of a T-shaped edge of a screen/blind included with the roller assembly and illustrated in a preferred embodiment of the invention.
Figure 39:
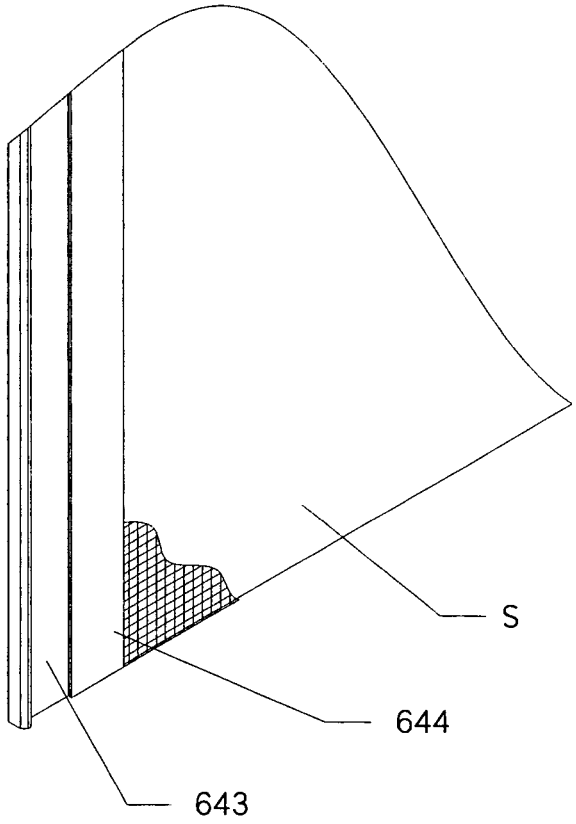
FIG. 39 is a partial cut away perspective view of a screen assembly with a T-shaped edge portion of FIG. 38.

FIG. 38 illustrates the preferred T-shaped key attached to the edge of blind S' and FIG. 39 illustrates the preferred T-shaped key attached to the bug screens. Other key shapes are also possible as taught in Applicant's prior patent abovementioned.

Figure 40:
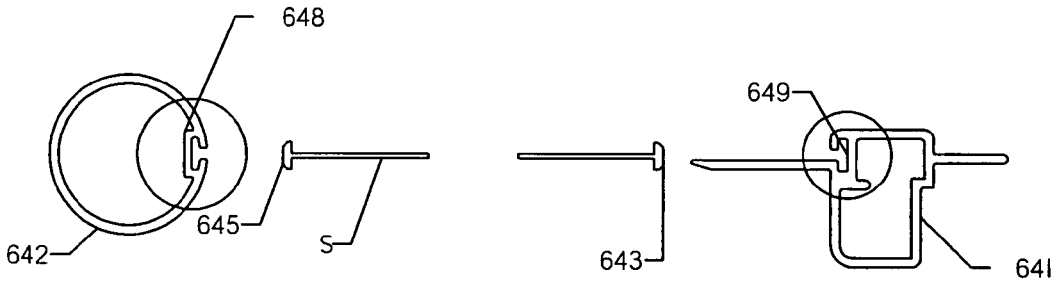
FIG. 40 is a schematic view of an installation of a screen for a retractable screen assembly illustrated in a preferred embodiment of the invention.
Figure 41:
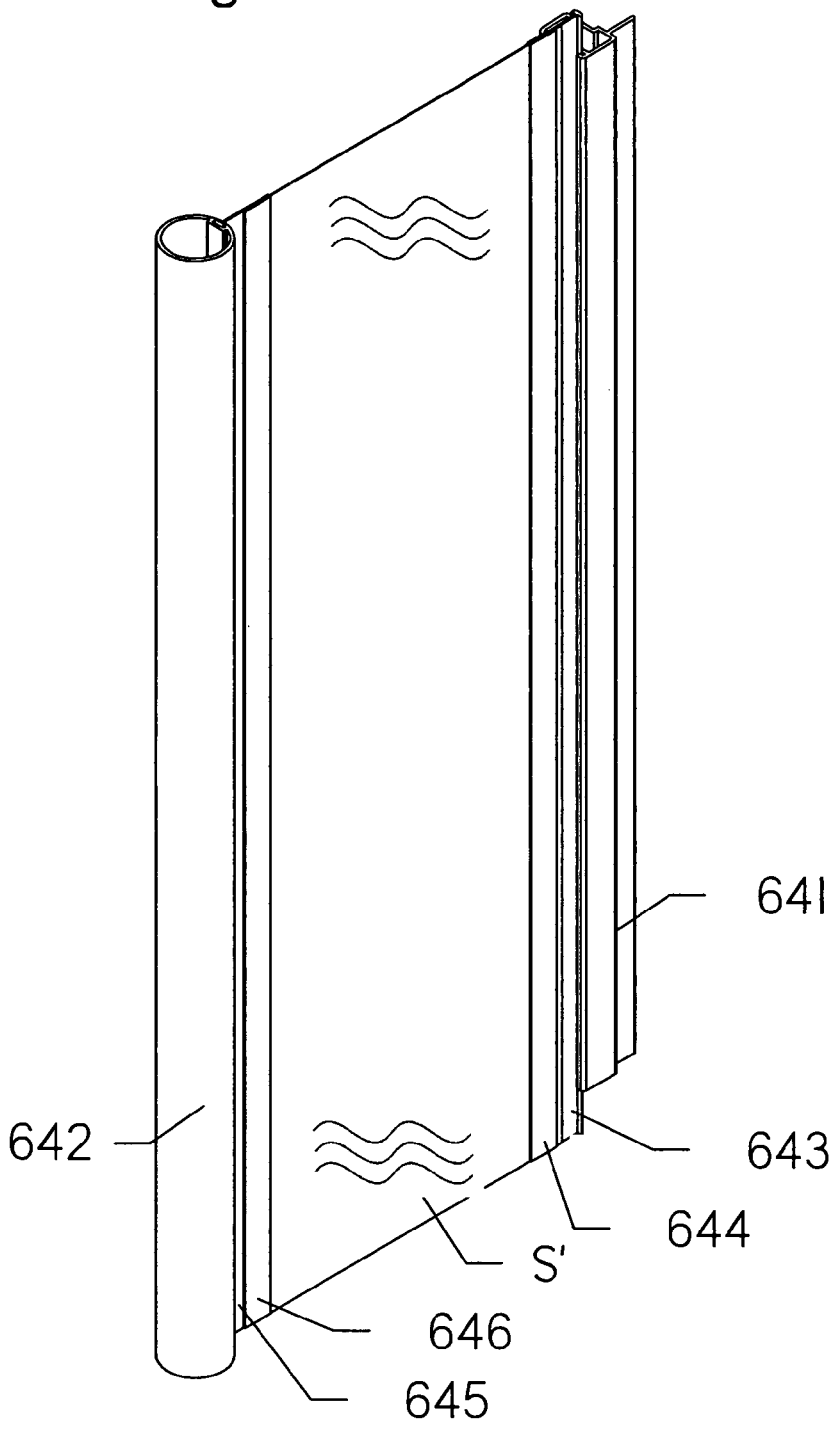
FIG. 41 is a perspective view of a blind, draw bar, and roller as assembled and illustrated in a preferred embodiment of the invention.

FIG. 40 shows how the T-shaped key members 645 and 643 fit into the T-shaped cavities 648 and 649 in the roller drum 642 and in the draw bar assembly 641. FIG. 41 illustrates screen S' fully attached to the roller drum and the draw bar as previously taught in Applicant's prior patent abovementioned.

Figure 42:
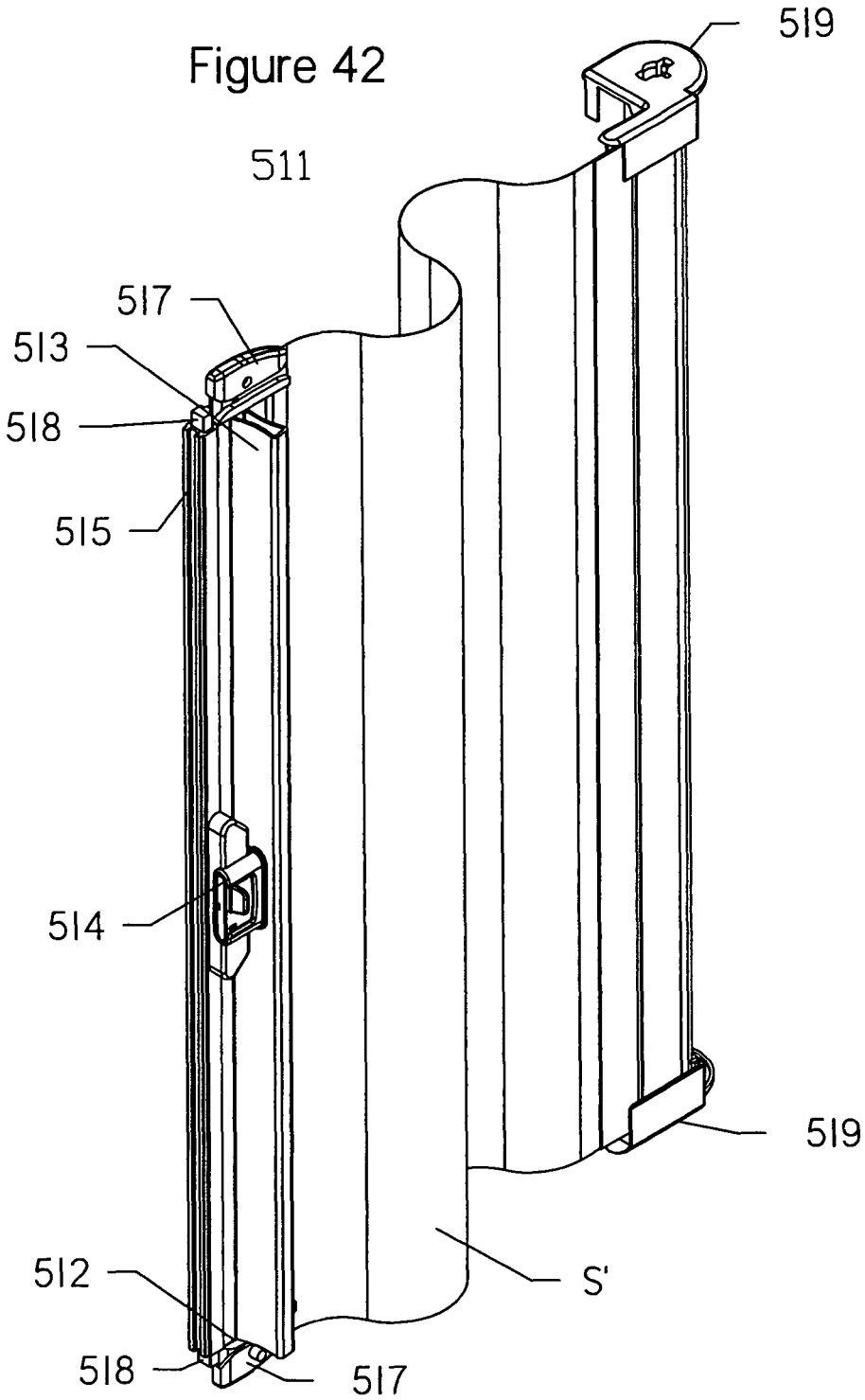
FIG. 42 is a perspective view of a screen cassette assembly, as previously illustrated and claimed in U.S. Pat. No. 6,267,168.

FIG. 42 illustrates screen cassette assembly 511 with partially extended blind S'. It is easy to see that draw bar 512 has a bug seal 515, handle 513 which may include a guide members 517 which guides the rollout assembly along the tracks. In addition, draw bar 512 include a latch operator 514 which controls the retractable pins 518 on the opposite ends of the draw bar. The latch operator is fully described in Applicants provisional application No. 60/689,068 incorporated herein by reference and from which this Application claims priority. The blind S' is attached to the draw bar 512 as explained above in relation FIGS. 37-41, by the same means blind S' is attached to the roller which is mounted on brackets 519 and 519' for installation in the jamb pockets. These brackets allows accurate installation of the screen cassette into the pocket inside the jamb illustrated in FIG. 43 without additional fastening means.

Figure 43:
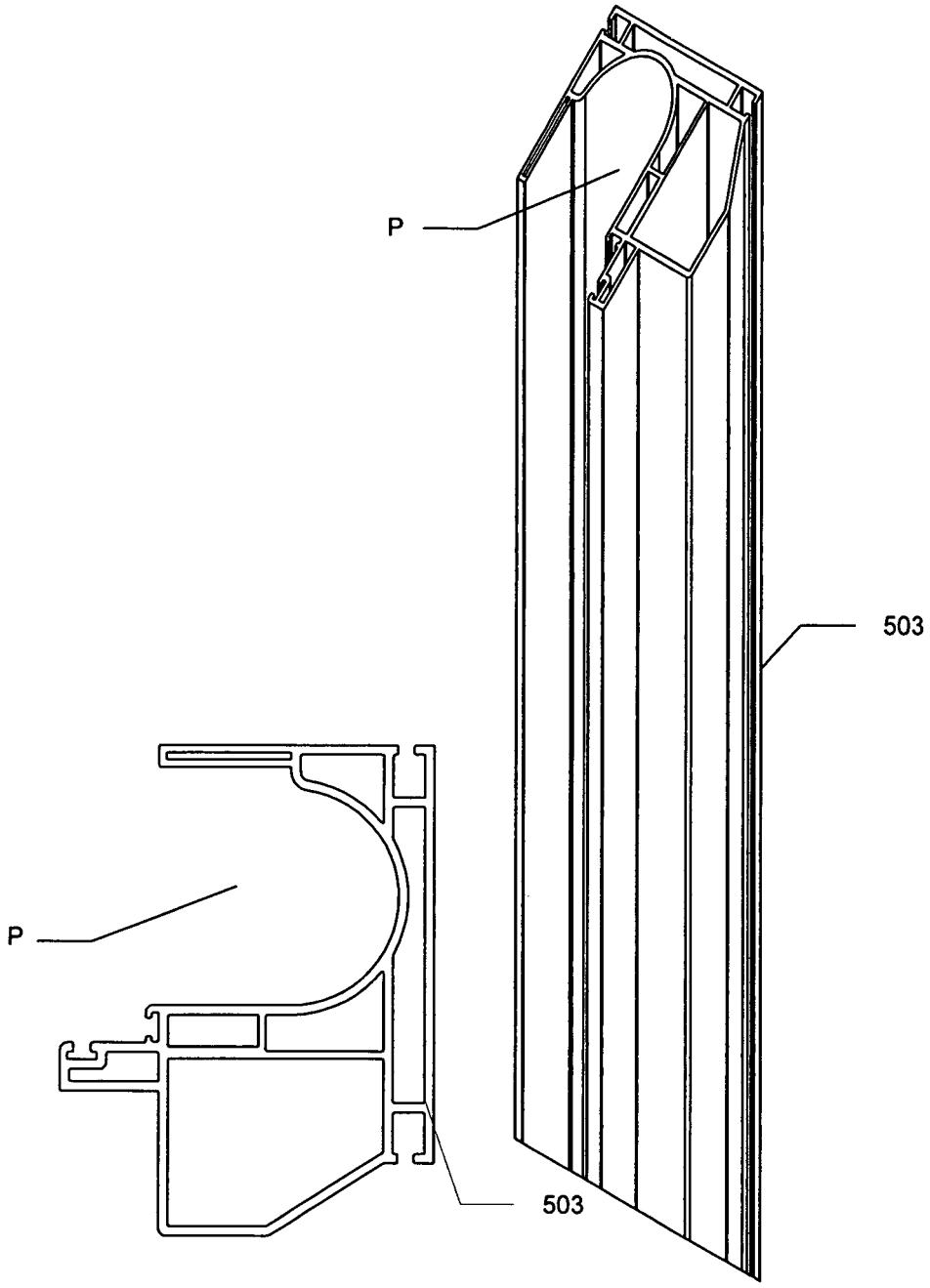
FIG. 43 is a cross section and perspective views of a jamb section with integral pocket construction as previously illustrated and claimed in U.S. Pat. No. 6,267,168.

FIG. 43 illustrates the profile of the jamb 503 and the details thereof with the pocket P as described in FIGS. 1-7, 9-23. Following the installation of the screen cassette 511 into the pocket P, brackets 519 and 519' engage with the surfaces of the interior of the pocket P, allowing the roll out assembly S or S' to extend from the cassette when pulling the draw bar handle to the required operating position, while the brackets are prevented from moving as taught in Applicant's prior patent abovementioned.

Figure 44:
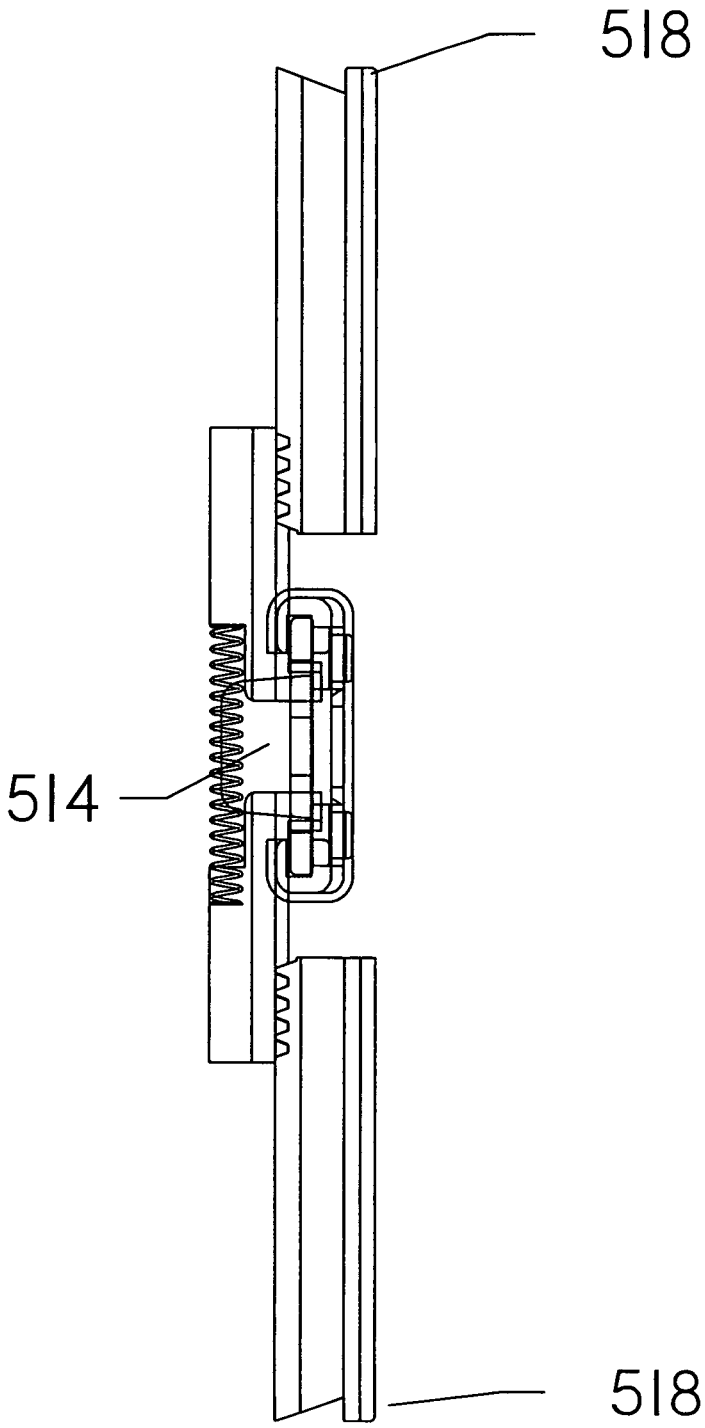
FIG. 44 is a side view of a latch operator for the draw bar of a roller assembly and illustrated in a preferred embodiment of the invention.
Figure 45:
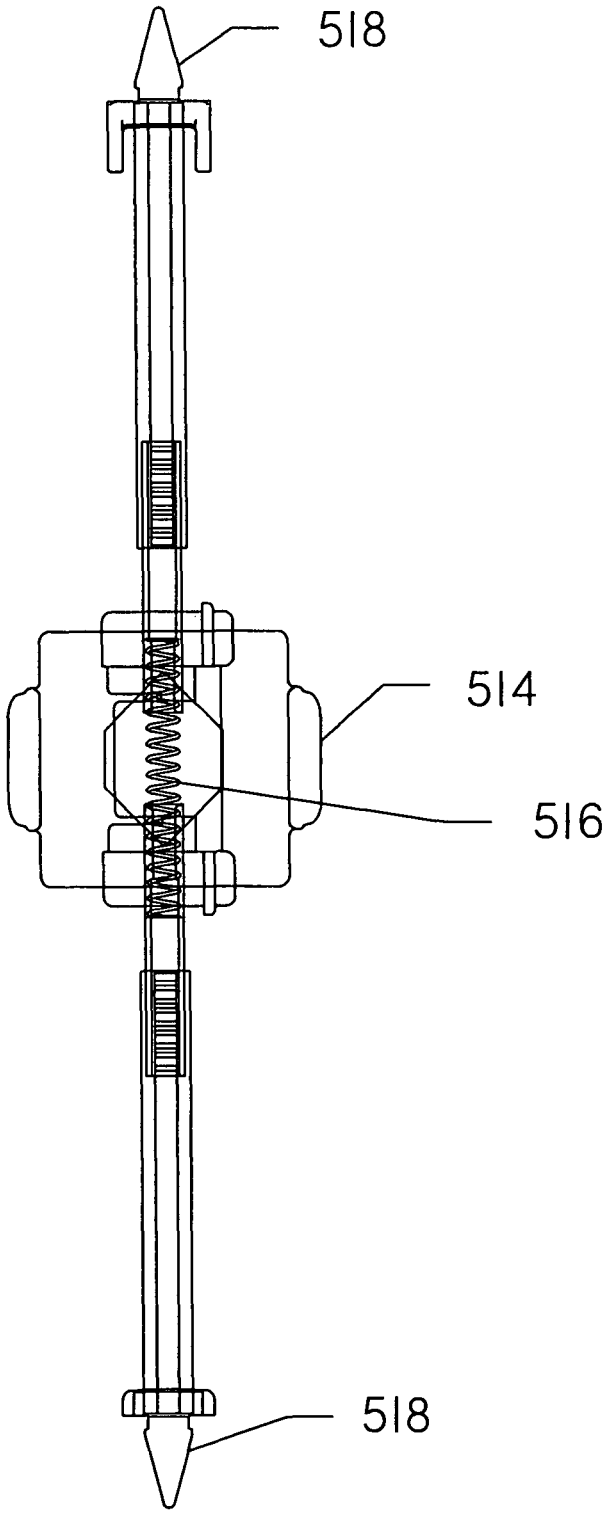
FIG. 45 is a front view of latch operator for the draw bar of a roller assembly illustrated in a preferred embodiment of the invention.

FIGS. 44 and 45 illustrate side and front view of the latch mechanism described in Applicant's prior application No. 60/689,068 incorporated herein by reference and from which priority is claimed. The retractable square pins 518, presented in one of numerous geometrical forms such as square, cylinder, or triangular for example, are activated by the latch operator 514. As best seen on FIG. 45, by the mean of horizontal motion of the latch operator 514 pulls the pins 518 into the draw bar assembly allowing the draw bar to move along the track T. This assembly is taught in Applicant's prior priority Application abovementioned. Releasing of the latch operator 514, the spring member 516 extends, and releases the pins 518 of the draw bar, so as to engage with one of the multiple detents D located along the tracks T as was previously disclosed above.

Figure 46:
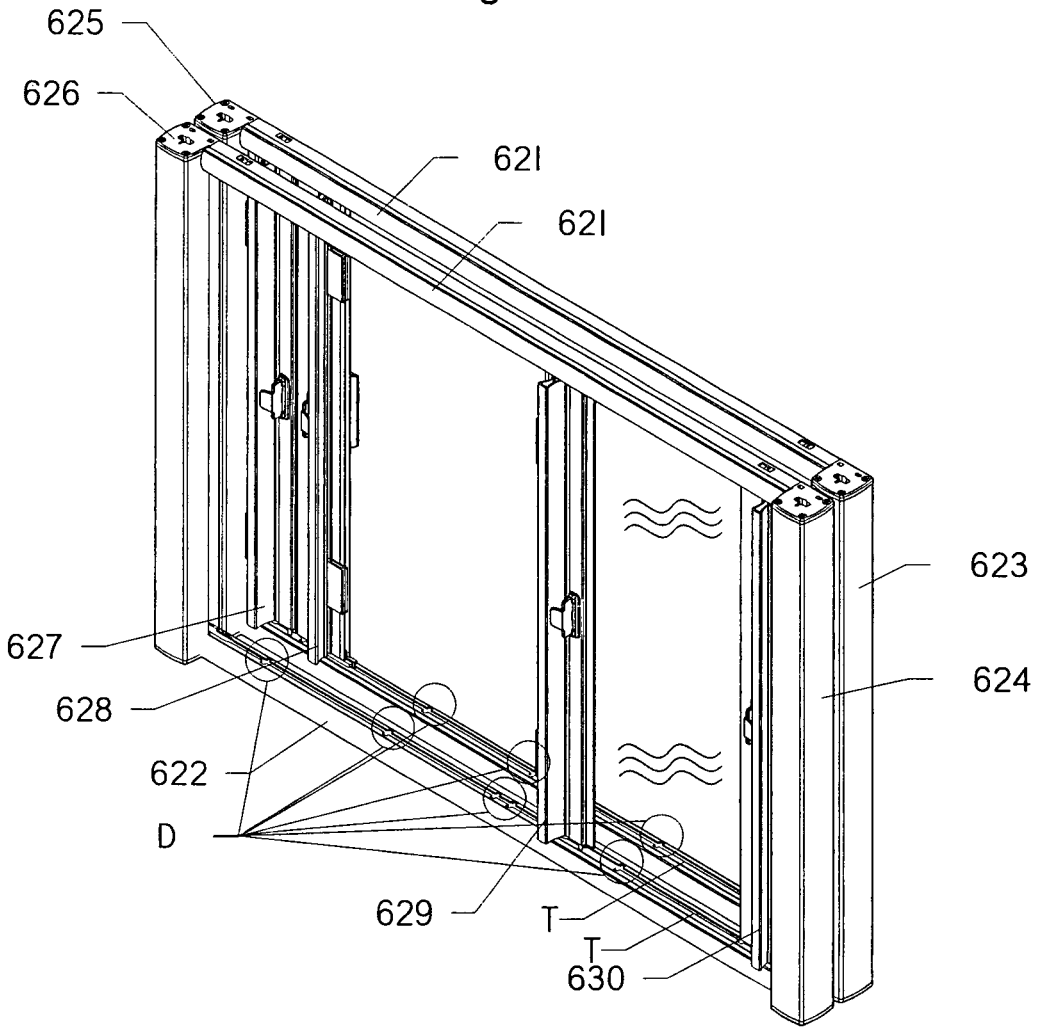
FIG. 46 is a schematic perspective view of a replacement screen frame including four roll out assemblies, illustrated in one embodiment of the invention.

Referring to FIG. 46, there illustrated an alternative embodiment of the invention including up to four roll out assemblies embodied into one add on or replacement screen assembly. Such an assembly if desired may be incorporated onto the frame of an existing window assembly or attached to the frame of a patio door assembly in the same way as has been previously described for add on and replacement screen. This assembly includes a top frame member 621 and a bottom frame member 622. In this case the frame includes two cassette housings on each side. For the front right side a housing and cassette 624 are provided and at the back housing 623 as well. At the left side housing cassettes 625 and 626 are also provided at the back and front as well.

Also shown in FIG. 46 are rollout assemblies extending from housings 624 and 625 in a fully retracted position while the rollout screen from the housing 623, with the draw bar 628, is fully extended from the right side to the left and rollout screen assembly from the housing 626 with draw bar 629, is partially extended to the right. This assembly is not a limiting one and it may for example include one bug screen in the cassette housing 623, a solar screen in cassette housing, 625 and two blinds within cassette housings 626 and 624, or other alternatives as desired.

Figure 47:
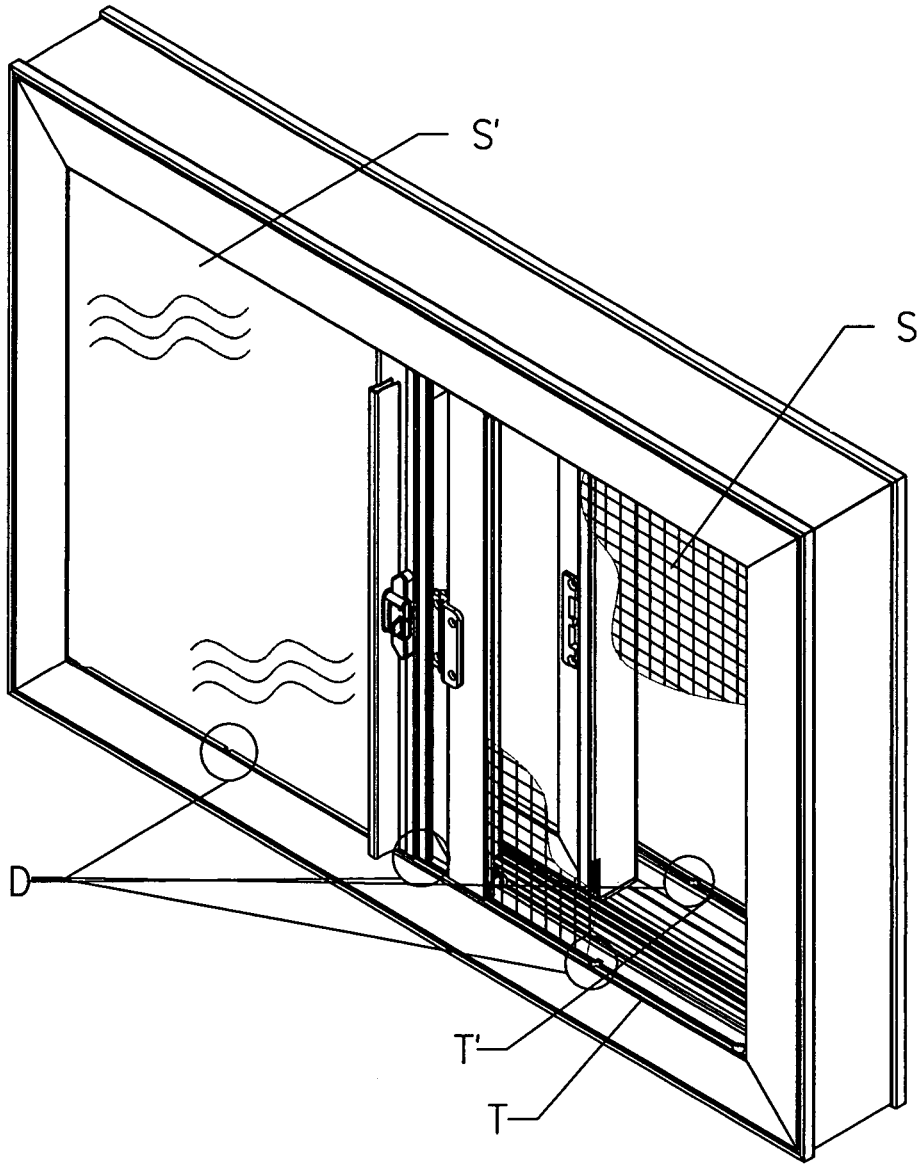
FIGS. 47 and 48 are schematic perspective views of a double slider window carrying three roll out assemblies therein and, illustrated in one embodiment of the invention.
Figure 48:
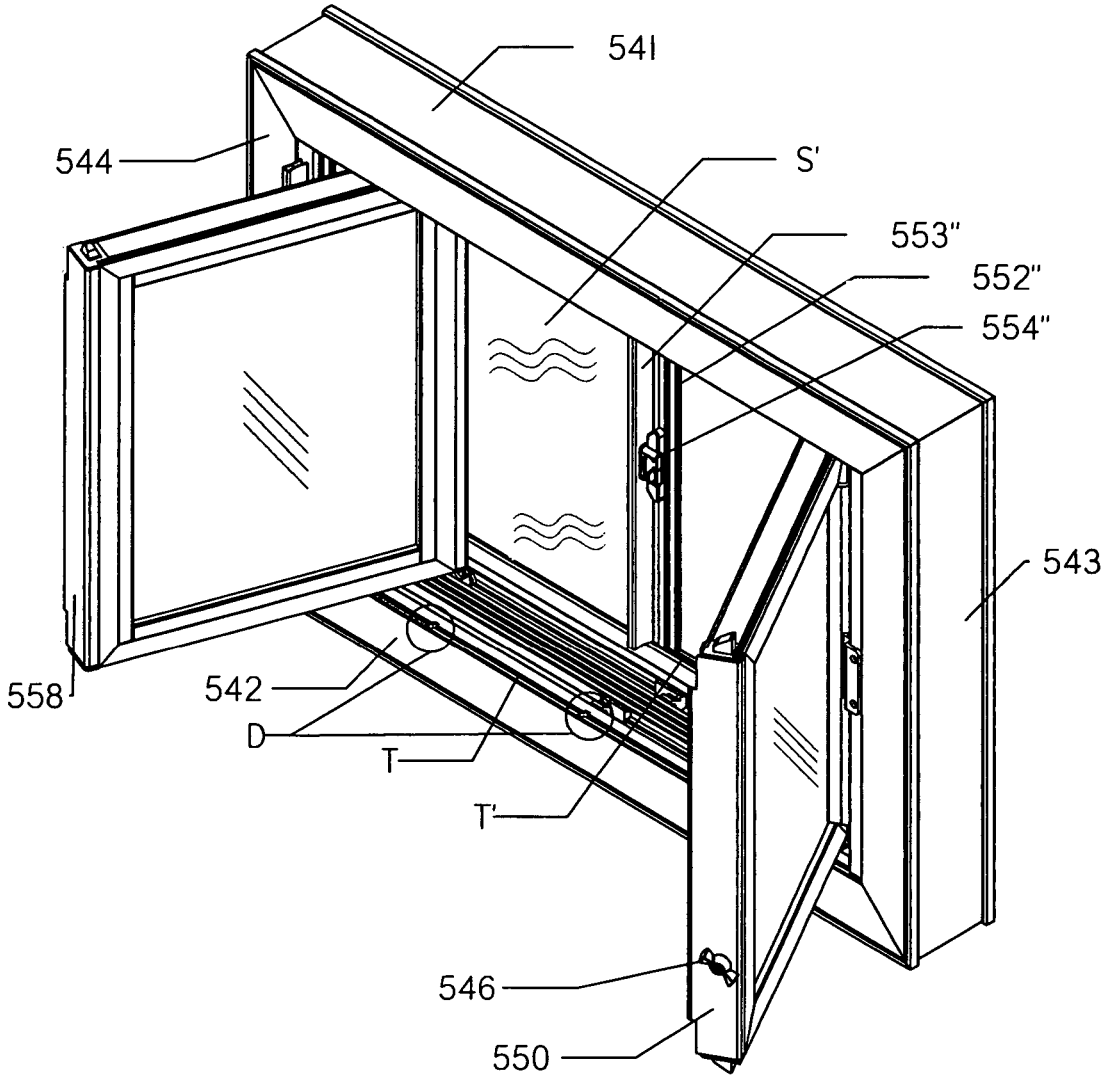

Referring now to FIGS. 47 and 48 there illustrated an alternative embodiment of the invention for a tilted slide window two moveable sashes incorporating three rollout assemblies therein. This assembly resembles the embodiments of FIGS. 13 and 14 with an additional track T' disposed in the sill and the header behind the sashes, and an additional pocket for a screen cassette located in the left jamb 544. The third solar screen S" is best seen in FIG. 48 with both sashes in a tilted and opened position.

It is important to note that each cassette is sized so as to be received in a pocket for the various embodiments of the invention. Thus the cassettes are interchangeable in position for the homeowners' convenience. Replacement cassettes are also readily available.

As many changes can be made to the preferred embodiments of the invention without departing from the scope thereof. It is intended that all matter contained herein be considered illustrated of the invention and not in a limiting sense.

The invention claimed is:

1. A closure assembly to be installed in an opening for a building, said closure assembly comprising a frame for supporting a moveable closure member therewithin, said frame including top, bottom and side members, at least two opposing of said members including a hollow pocket within the interior of said member having interior surfaces having a first shape and adapted for matingly receiving a spring biased roller assembly and integral mounting brackets, upon which a flexible material is accumulated, said flexible material being engaged with a draw bar at the free end thereof, and engaged with a spring biased roller at the other end, said spring biased roller being engaged with said integral mounting brackets permitting slidable installation and removal of the spring biased roller assembly and said integral mounting brackets in mating engagement within the hollow pocket, each of said integral mounting brackets having a leading edge matingly compatible in shape with said interior surfaces of said hollow pocket and thereby prevented from movement as said integral mounting brackets matingly engage with the interior surfaces of the hollow pocket and another of the top, bottom and side members, absent any further fastener, permitting slidable removal and replacement of said roller assembly and said integral mounting brackets; said flexible material being selected from a blind, a bug screen, and a solar screen, the flexible material being movable between a fully retracted first position whereat the material is contained within the pocket of said member to a fully extended second position whereat the material covers some or all of the opening of the building; said integral mounting brackets remaining unfastened with respect to said frame, permitting slidable removal and replacement of said roller assembly integral with said mounting brackets from/to said hollow pocket, wherein the draw bar is connected to the free end of said flexible material, and said draw bar includes guides which ride in track portions, said guides include retractable pins which are retracted by the operation of a locking mechanism provided with said draw bar while said tracks include multiple locking detents for engagement with said retractable pins at a number of predefined positions along said track to enable positioning of the flexible material at those positions, such as in the case when the flexible material is a blind, these positions may further comprise fully extended, half extended and fully retracted positions.

2. The assembly of claim 1 wherein the flexible materials is selected from solar screening and bug screening.

3. The assembly of claim 1 or 2 wherein closure assembly is selected from patio doors, double hung windows, single hung windows, tilt and slide windows with single movable and double movable sashes, casement windows, double casement windows, awning windows, exit doors and screen doors.

4. The assembly of claim 1 wherein said members further comprise a header, sill, and two jambs.

5. The assembly of claim 4 wherein two of the members include a hollow pocket.

6. The assembly of claim 5 wherein said hollow pocket is integrately formed with said member.

7. The assembly of claim 6 wherein said spring biased roller assembly is fully contained in said hollow pocket.

8. The assembly of claim 7 wherein other frame members, when the pocket is provided in opposing jambs, include track portions for guiding a leading edge of the flexible material to and from the first and second positions as the flexible material moves across the building opening.

9. The assembly of claim 8 wherein the draw bar is connected to the leading edge of said flexible material, and said draw bar includes guides which ride in said track portions.

10. The assembly of claim 9 wherein said guides include retractable pins which are retracted by the operation of a locking mechanism provided with said draw bar.

11. The assembly of claim 10 wherein said tracks include multiple locking detents for engagement with said retractable pins at a number of predefined positions along said track to enable positioning of the flexible material at those positions, such as in the case when the flexible material is a blind, these positions may further comprise fully extended, half extended and fully retracted positions.

12. The assembly of claim 1 wherein said flexible material is bug screening extending from the pocket of one member, and blind material extending from the pocket of a second member.

13. The assembly of claim 1 wherein when the closure assembly is a double casement window assembly and blind material or solar screening is disposed in the pocket of one of the frame members, the blind or solar screen is fully extendable across both casement windows, and also extends in a second manner across only one casement window, wherein the pocket of the opposing frame member may contain bug screening operating in the same manner.

14. The assembly of claim 9, 10, or 11 wherein when bug screening extends from both pockets, and the draw bars thereof engage the track at predetermined positions, both screens combine to fully cover the full extent of the opening of the building.

15. A closure assembly for a patio door or entry door, the closure assembly comprising two ends and two sides and having disposed at each end, or each side, a housing having interior surfaces having a first shape and containing a spring biased roller assembly cassette upon which a flexible material is accumulated, said cassette being matingly engaged to said interior surface of said housing with integral mounting brackets, each of said integral mounting brackets having a leading edge compatible in shape with said interior surfaces of said housing and thereby permitting slidable installation and removal of the cassette and integral mounting brackets in the housing, said integral mounting brackets being prevented from movement by said brackets matingly engaging the interior surfaces of the housing, and the ends or sides, absent any further fastener permitting slidable removal and replacement of said cassette assembly and integral mounting brackets; the flexible material being moveable, from a fully retracted position in said housing to a fully extended position, within a track disposed with each side or at each end of the assembly, said track including a multiplicity of detents positioned for retaining a leading edge of the flexible material extending from each spring biased roller assembly cassette and for engaging said leading edge with said track at each of said positions, adjacent the leading edge of said flexible material, said leading edge including a draw bar with guides and corresponding operative pins which are retracted by the operation of a locking mechanism provided with said draw bar for engagement with said multiplicity of detents of each track, said flexible material being selected from solar screening, bug screening and blinds, wherein when needed the applicable material may be moved between the fully retracted and fully extended position, each of said integral mounting brackets remaining unfastened with respect to said frame permitting slidable removal and replacement of said cassette assembly and integral mounting brackets with said interior surface of said housing.

16. A screen assembly for a patio door or entry door, the screen assembly comprising two ends and two sides and having disposed at each end, or each side, a housing having interior surfaces having a first shape and containing a spring biased roller assembly cassette upon which a flexible material is accumulated, said cassette being matingly engaged with the interior surfaces of said housing with integral mounting brackets; each of said integral mounting brackets having a leading edge compatible in shape with said interior surfaces of said housing permitting slidable installation and removal of the cassette along with said integral mounting brackets in the housing, said mounting brackets being prevented from movement by said brackets engaging the interior surfaces of the housing and the ends or sides of the frame, the flexible material being moveable, from a fully retracted position in said housing to a fully extended position, within a track disposed with each side or at each end of the assembly, said track including a multiplicity of detents positioned for retaining a leading edge of the flexible material extending from each spring biased roller assembly cassette and for engaging said leading edge with said track at each of said positions, adjacent the leading edge of said flexible material, said leading edge including a draw bar with guides and corresponding operative pins which are retracted by the operation of a locking mechanism provided with said draw bar for engagement with said multiplicity of detents of each track, for engagement at said multiplicity of detents of each track, said flexible material being selected from solar screening, bug screening and blinds, wherein when needed the applicable material may be moved between the fully retracted and fully extended positions; each of the integral mounting brackets which form part of said cassette remaining unfastened with respect to said frame, permitting slidable removal and replacement of said cassette absent any further fasteners.

17. The screen assembly of claim 16 further comprising a screen assembly for a patio door or entry door.

18. The screen assembly of claim 17 wherein said patio door is a French door assembly.

19. The assembly of claim 15 or 16 wherein at least three housings are provided, each carrying flexible material on the spring biased roller assembly cassette.

20. The assembly of claim 19 wherein the flexible material for each cassette is unique.

21. The assembly of claim 19 wherein the flexible material for each cassette is not unique.

22. A method for readily interchanging the material covering an opening of a closure assembly having frame members comprising; a plurality of interchangeable spring biased roller cassettes each integrally engaged with two mounting brackets and to be inserted in the pocket of a frame member of the closure assembly, said pocket having a first shape and a leading edge of each of said mounting brackets being matingly compatible in shape with said pocket: the system including the steps of;

(a) providing a standard design for each of the cassettes integrally engaged with the mounting brackets and including a draw bar disposed at the free end and a roller disposed at the other end whereat the material is accumulated and said roller being mounted on said brackets;

(b) making available various materials extending between said draw bar and the roller for each interchangeable cassette;

(c) providing a standard pocket design with interior surfaces adapted to receive said interchangeable cassette and integral mounting brackets and to receive each interchangeable cassette in such a manner that the interchangeable cassette may be readily placed into the pocket and removed from the pocket, wherein each of said integral mounting brackets matingly engage with the interior surfaces of the pocket, absent any further fastener, and prevented from movement only by mating engagement with the interior surfaces of said pocket and said frame member and each of said mounting brackets, when said material is paid out and accumulated on the roller in said pocket; and (d) replacing the interchangeable cassette as desired as the need arise for the appropriate conditions; wherein a homeowner may easily replace the material covering the opening of the closure assembly by interchanging the interchangeable cassette as desired, each of said integral mounting brackets remaining unfastened with respect to said frame, permitting slidable removal and replacement of said cassette assembly and each of said integral mounting brackets.

23. The method of claim 22 further comprising a spring biased roller upon which the flexible material is accumulated.

24. The method for interchanging the interchangeable screen cassettes of claim 23 consisting of at least two steps:

removal of a first cassette containing a first material from the pocket of the frame member, followed by the insertion of second cassette carrying a second material into the pocket of the frame member wherein said integral mounting brackets engage with the interior surfaces of the pocket and are prevented from movement only by matingly engagement of the interior surfaces of said pocket and said integral mounting brackets of said second cassette.

* * * * *